US010699517B1

(12) United States Patent
Berman et al.

(10) Patent No.: US 10,699,517 B1
(45) Date of Patent: Jun. 30, 2020

(54) SYSTEMS, APPARATUSES AND METHODS FOR OPTIONALLY REPLAYING PORTIONS OF GAMING GRIDS

(71) Applicant: KING SHOW GAMES, INC., Minnetonka, MN (US)

(72) Inventors: Bradley Berman, Minnetonka, MN (US); Jacob Lamb, Maple Grove, MN (US); Nicholas Compton, Crystal, MN (US)

( * ) Notice: Subject to any disclaimer, the term of this patent is extended or adjusted under 35 U.S.C. 154(b) by 209 days.

(21) Appl. No.: 15/806,467

(22) Filed: Nov. 8, 2017

Related U.S. Application Data

(60) Provisional application No. 62/419,392, filed on Nov. 8, 2016.

(51) Int. Cl.
*G07F 17/00* (2006.01)
*G07F 19/00* (2006.01)
*G07F 17/32* (2006.01)

(52) U.S. Cl.
CPC ..... *G07F 17/3213* (2013.01); *G07F 17/3209* (2013.01); *G07F 17/3225* (2013.01); *G07F 17/3251* (2013.01)

(58) Field of Classification Search
CPC .. G07F 17/32; G07F 17/3209; G07F 17/3213; G07F 17/3244; G07F 17/3262; G07F 17/3265; G07F 17/326; G07F 17/3267; G07F 17/34
See application file for complete search history.

(56) References Cited

U.S. PATENT DOCUMENTS

| | | | | |
|---|---|---|---|---|
| 5,704,835 | A | 1/1998 | Michael | |
| 6,129,632 | A | 10/2000 | Luciano | |
| 6,939,223 | B1 | 9/2005 | Jones | |
| 6,942,567 | B2 | 9/2005 | Baerlocher et al. | |
| 7,252,589 | B1 | 8/2007 | Marks et al. | |
| 7,393,278 | B2 | 7/2008 | Gerson et al. | |
| 7,465,229 | B2 | 12/2008 | Shuster | |
| 7,559,836 | B2 | 7/2009 | Gerson et al. | |
| 7,713,123 | B2 | 5/2010 | Gerson et al. | |
| 8,376,829 | B2 | 2/2013 | Nores | |
| 8,480,482 | B2 | 7/2013 | Walker et al. | |
| 8,517,813 | B2 | 8/2013 | Berman et al. | |
| 8,636,585 | B2 | 1/2014 | Shuster | |
| 8,758,115 | B2 | 6/2014 | Roemer et al. | |
| 2003/0224849 | A1* | 12/2003 | Geiger | G07F 17/32 463/20 |
| 2006/0160595 | A1* | 7/2006 | Gerson | G07F 17/32 463/16 |

(Continued)

OTHER PUBLICATIONS

Vegas Slots Online "Reel Respin Slot Feature", www.vegasslotsonline.com, dated Mar. 2017.

*Primary Examiner* — Milap Shah

(57) ABSTRACT

Systems, apparatuses and methods for facilitating replay of a subset of a game play grid. In the context of a slot game, a player is allowed to respin a reel(s) in an effort to improve the gaming activity result. The respin cost may be calculated by determining estimated values for each distinct symbol type on the reel providing the replacement symbols, and determining a total estimated value for all symbol types, rather than cycling through all permutations of symbol combinations resulting from the state of the slot grid and the replacement reel.

16 Claims, 13 Drawing Sheets

(56) References Cited

U.S. PATENT DOCUMENTS

| | | | | |
|---|---|---|---|---|
| 2006/0252495 | A1* | 11/2006 | Gerson | G07F 17/32 463/20 |
| 2006/0264255 | A1 | 11/2006 | Borissov | |
| 2007/0254735 | A1 | 11/2007 | Marks et al. | |
| 2009/0093296 | A1* | 4/2009 | Gerson | G07F 17/32 463/20 |
| 2014/0141859 | A1 | 5/2014 | Shuster | |
| 2016/0321871 | A1* | 11/2016 | Plowman | G07F 17/326 |

* cited by examiner

900A

| | | | | |
|---|---|---|---|---|
| M1 | F4 | M3 | M1 | M1 |
| F4 | M1 | F4 | M1 | M1 |
| F5 | F5 | M3 | F5 | F5 |

908 909 910 911 912 913 914 902

904

| LENGTH | 3 | 4 | 5 |
|---|---|---|---|
| M1 | 5 | 10 | 25 |
| F4 | 3 | 5 | 10 |
| F5 | 1 | 2 | 3 |

906

| PAYLINE \ COLUMN | 1 | 2 | 3 | 4 | 5 |
|---|---|---|---|---|---|
| 1 | 2 | 2 | 2 | 2 | 2 |
| 2 | 1 | 1 | 1 | 1 | 1 |
| 3 | 3 | 3 | 3 | 3 | 3 |
| 4 | 1 | 2 | 3 | 2 | 1 |
| 5 | 3 | 2 | 1 | 2 | 3 |
| 6 | 1 | 1 | 2 | 1 | 1 |
| 7 | 3 | 3 | 2 | 3 | 3 |
| 8 | 2 | 3 | 3 | 3 | 2 |
| 9 | 2 | 1 | 1 | 1 | 2 |
| 10 | 1 | 2 | 2 | 2 | 1 |
| 11 | 3 | 2 | 2 | 2 | 3 |
| 12 | 1 | 2 | 1 | 2 | 1 |
| 13 | 3 | 2 | 3 | 2 | 3 |
| 14 | 2 | 1 | 2 | 1 | 2 |
| 15 | 2 | 3 | 2 | 3 | 2 |
| 16 | 2 | 2 | 1 | 2 | 2 |
| 17 | 2 | 2 | 3 | 2 | 2 |
| 18 | 1 | 3 | 1 | 3 | 1 |
| 19 | 3 | 1 | 3 | 1 | 3 |
| 20 | 2 | 1 | 3 | 1 | 2 |
| 21 | 2 | 3 | 1 | 3 | 2 |
| 22 | 1 | 1 | 3 | 1 | 1 |
| 23 | 3 | 3 | 1 | 3 | 3 |
| 24 | 1 | 3 | 3 | 3 | 1 |
| 25 | 3 | 1 | 1 | 1 | 3 |
| 26 | 1 | 3 | 2 | 3 | 1 |
| 27 | 3 | 1 | 2 | 1 | 3 |
| 28 | 1 | 1 | 2 | 3 | 3 |
| 29 | 3 | 3 | 2 | 1 | 1 |
| 30 | 2 | 1 | 2 | 3 | 2 |

FIG. 9A

SYSTEMS, APPARATUSES AND METHODS FOR OPTIONALLY REPLAYING PORTIONS OF GAMING GRIDS

FIELD

This disclosure relates generally to games, and more particularly to systems, apparatuses and methods for providing an optional respin of one or more reels during a gaming event in gaming devices.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is due to the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes systems, apparatuses and methods that facilitate new and interesting gaming experiences, and provide advantages over the prior art.

SUMMARY

The present disclosure is directed to systems, apparatuses, computer-readable media, and/or methods that are configured to enable one or more portions of a gaming activity to be replayed. For example, in the context of a slot game, a player is allowed to respin a reel(s) in an effort to improve the gaming activity result. The respin cost may be calculated by determining estimated values for each distinct symbol type on the reel providing the replacement symbols, and determining a total estimated value for all symbol types, rather than cycling through all permutations of symbol combinations resulting from the state of the slot grid and the replacement reel.

In accordance with one embodiment, a slot game apparatus is provided that includes a display, a user interface, a wager input device, and a processor. The display presents a plurality of symbol locations forming a symbol array. The user interface includes a user input to enable a player to initiate a slot game event presented via the symbol array. The wager input device is structured to identify and validate player assets, and to permit the player to play the slot game event when the player assets are provided. The processor is configured to present a first result of the slot game event, and calculate a respin cost to respin a reel that would provide a set of replacement symbols for the visible reel portion presented in the subset of the slot game array. In one embodiment, calculating the respin cost involves calculating the total expected value to the player for respinning the reel, by calculating the expected value of each distinct symbol on the replacement reel strip and providing a sum of the expected values of each distinct symbol to arrive at the total expected value, where the respin cost is then established relative to the total expected value to the player. The processor is further configured to respin the reel and provide the set of replacement symbols for the subset of the slot game array in response to accepting the respin cost.

In a more particular embodiment of such a slot game apparatus, the processor is further configured to present the established respin cost proximate the reel to create an association of the established respin cost with the reel, and to enable the player to choose whether to respin the reel at the established respin cost.

In another embodiment, the processor is configured to calculate the expected value of each distinct symbol on the replacement reel strip by (a) maintaining the symbols of the first result of the slot game event on the slot game array, except for the subset of the slot game array; (b) populating all symbol locations of the subset of the slot game array with one of a plurality of replacement symbols available on the replacement reel strip; (c) calculating the expected value for the replacement symbol; (d) performing (b) and (c) for each of the distinct symbols on the replacement reel strip; and (e) calculating the total expected value to the player for respinning the reel by providing the sum of the expected values of each of the distinct symbols on the replacement reel strip.

The processor may be configured to calculate a respin cost for each of the reels used in the slot game event. In one embodiment, the processor is further configured to present the calculated respin costs for each of the reels proximate its respective one of the reels to create associations of the respin costs with its respective one of the reels, and to enable the player to choose which one or more of the reels to respin at its respective respin cost.

The processor may be configured to establish the respin cost to be equal to the total expected value, while in other embodiments the respin cost may be set to an amount lower than the calculated total expected value. In still other embodiments, the processor is configured to establish the respin cost to be higher than the total expected value, such as, for example, setting the respin cost above the total expected value to the player by an amount commensurate with a payout percentage of the slot game.

In one embodiment, the calculated total expected value corresponds to a mathematical average expected return for the wager in response to the respin of the reel. Further, the replacement reel strip may be a physical reel strip, or an electronic or "virtual" reel strip. In some embodiments, the subset of the slot game array includes a single symbol location, where in other embodiments it includes multiple symbol locations arranged in some way, such as in a row of the slot game array, or in a column of the slot game array, etc.

In accordance with anther embodiment, a slot game device is provided for facilitating optional replay of portions of a slot game. The device is provided that includes a display, a user interface, a wager input device, and a processor. The display presents a plurality of symbol locations forming a symbol array. The user interface includes a user input to enable a player to initiate a slot game event presented via the symbol array. The wager input device is structured to identify and validate player assets, and to permit the player to play the slot game event when the player assets are provided. The processor is configured to (a) present a result of the slot game event including symbols populating a slot game grid comprising rows and columns; (b) provide respin costs for each of the columns of the slot game grid; (c) facilitate player decision to respin a reel that populates one of the columns at its respective one of the respin costs; (d) facilitate player identification of the reel where the respin of the reel is to occur; (e) respin the elected reel to respin at its respective respin cost; (f) present an updated result of the slot game event; and (g) repeat (b)-(f) until the player has opted not to respin any of the reels.

In a more particular embodiment of such a slot game device, the processor is configured to provide respin costs by determining a total expected value to the player for respinning the respective reel, by calculating the expected value of each distinct symbol on the respective reel and providing a sum of the expected values of each distinct symbol to arrive at the total expected value, and to establish the respin cost based on the calculated total expected value. In a more particular embodiment, the processor is configured to calculate the expected value of each distinct symbol on the replacement reel strip by (a) maintaining the symbols of the result of the slot game event on the slot game grid, except for the symbols at the reel subject to the respin; (b) populating all symbol locations column associated with the reel subject to the respin with one of a plurality of replacement symbols available on the respective reel; (c) calculating the expected value for the replacement symbol; (d) performing (b) and (c) for each of the distinct symbols on the reel subject to the respin; and (e) calculating the total expected value to the player for respinning the respective reel by providing the sum of the expected values of each of the distinct symbols on the respective reel. In one embodiment, the processor is configured to establish the respin cost based on the total expected value to the player by setting the respin cost above the total expected value to the player by an amount commensurate with a payout percentage of the slot game.

This summary serves as an abbreviated, selective introduction of a representative subset of various concepts and embodiments that are further described or taught to those skilled in the art in the Specification herein. This summary is not intended to refer to all embodiments, scopes, or breadths of claims otherwise supported by the Specification, nor to identify essential features of the claimed subject matter, nor to limit the scope of the claimed subject matter.

BRIEF DESCRIPTION OF THE DRAWINGS

FIGS. 9A-9B depict an example for calculating slot game respin costs in accordance with one embodiment.

DETAILED DESCRIPTION

Figure 1:
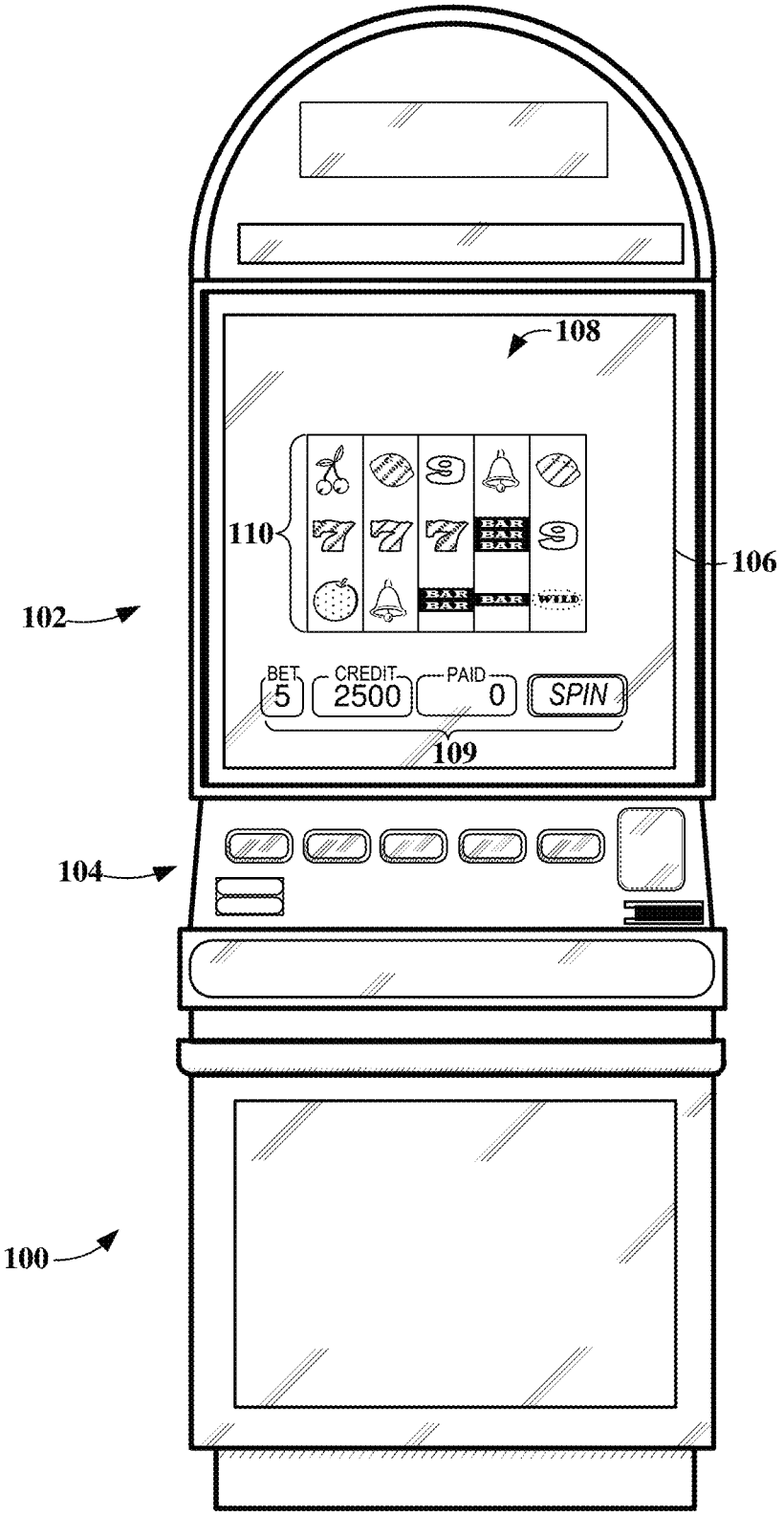
FIG. 1 is a diagram of a representative gaming machine capable of facilitating player use and interaction with games and features in accordance with the invention and representative embodiments described herein.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatuses.

In various embodiments, the gaming displays are described in conjunction with the use of data in the form of "symbols." In the context of this disclosure, a "symbol" may generally refer at least to a collection of one or more arbitrary indicia or signs that have some conventional or defined significance. In particular, the symbol may represent values that can at least be used to determine whether to award a payout. A symbol may include numbers, letters, shapes, pictures, textures, colors, sounds, etc., and any combination therebetween. A play state, such as a win, can be determined by comparing the symbol with one or more other symbols. Such comparisons can be performed, for example, via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for providing an optional subsequent chance, such as a slot respin, of some portion or subset of the gaming activity. For example, in the context of a slot game, an optional respin(s) of one or more reels or other symbol locations is provided during a gaming event(s) played on a gaming device(s). The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that involves enabling players to optionally elect to respin one or more reels on a slot game, or otherwise replay some portion of a gaming event.

In one representative embodiment, a gaming device includes a player ability to purchase a respin of one or more of the game reels. For example, if the player got stacked M1 symbols on reels 2-5 and had a "players choice" re-spin, they could choose to re-spin reel 1 in the hopes of picking up an M1 stack there. This may have some amount of strategy in some embodiments. Alternatively, there may be a triggering symbol that allows the ability to re-spin one or more of the game reels. For example, there may be an option to wager an additional 30 credits on a 30 line game to be eligible for the ability to re-spin one or more game reels. In some embodiments, there may be a caveat that re-spins cannot be bought during a spin, they can only be purchased between spins. This may prevent players from buying them only when the value of the re-spin exceeds its cost. The side wager or cost to be eligible for the player's choice respin may be set so that it is optimally useful only in certain situations with potentially large rewards. This may create a game state where players are encouraged to use the respin only in situations that can really improve the game outcome Numerous variations are possible in view of these and other embodiments of the inventive concept. Representative embodiments and variations are described herein, with some embodiments described with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, roulette, bingo, or other games of chance. Some of these other types of embodiments will be discussed below as variations to the examples illustrated. However, many other types of games can implement similar techniques and fall within the scope of this disclosed concept.

Referring to the example gaming apparatus 100 shown in FIG. 1, the representative gaming apparatus includes at least a display area(s) 102 (also referred to as a gaming display), and a player interface area(s) 104, although some or all of the interactive mechanisms included in the user interface area 104 may be provided via other or additional means, such as graphical icons used with a touch screen in the display area 102 in some embodiments. The display area 102 may include one or more game displays 106 (also referred to as "displays" or "gaming displays") that may be included in physically separate displays or as portions of a common large display. Here, the representative game display 106 includes at least a primary game play portion 108 that displays game elements and symbols 110, and an operations portion 109 that can include meters, various game buttons and other input mechanisms, and/or other game information for a player of the gaming device 100.

The user interface 104 allows the user to control, engage in play of, and otherwise interact with the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, touchscreen input, tactile input, and/or any other user input system or mechanism that allows the user to play and interact with the particular gaming activity.

The user interface 104 may allow the user or player to enter coins, bills, or otherwise obtain credits through vouchers, tokens, credit cards, tickets, electronic money, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player information, such as player loyalty information to identify a user or player of the gaming device. This mechanism may be, for example, a card reader, biometric scanner, keypad, or other input device. It is through a user interface such as the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as pay table information associated with a glass/plastic panel(s) on the gaming machine 100 and/or graphical images. The symbols or other indicia associated with the play of the game may be presented on an electronic display device or on mechanical devices associated with a mechanical display. Generally, in some embodiments, the display 106 devotes the largest portion of viewable area to the primary gaming portion 108. The primary gaming portion 108 may provide visual feedback to the user for any selected game. The primary gaming portion 108 may render graphical objects such as cards, slot reels, dice, animated characters, and any other gaming visual known in the art. The primary gaming portion 108 may also inform players of the outcome of any particular event, including whether the event resulted in a win or loss.

In some example embodiments illustrated herein, the primary gaming portion 108 may display a grid (or equivalent arrangement) of game elements 110 or game element positions (also referred to herein as "reel stop positions"). As illustrated in the embodiment shown in FIG. 1, the grid includes three rows and five columns of game elements 110, which may form a game outcome(s) of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as pay tables, navigation controls, etc.

Figure 2:
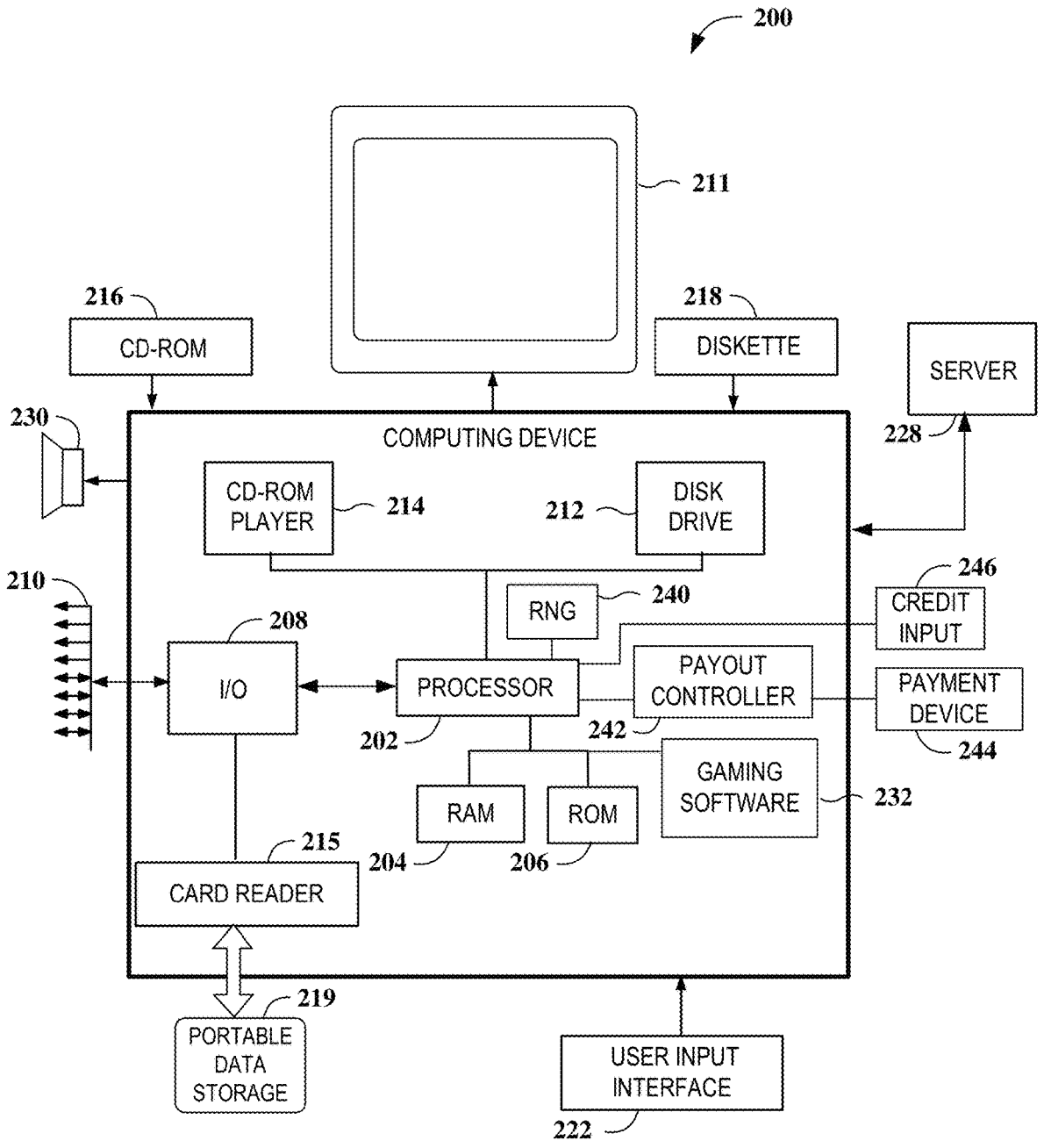
FIG. 2 is a block diagram illustrating a representative computing arrangement capable of implementing games and features in accordance with the invention and representative embodiments described herein.

Although FIG. 1 illustrates a particular implementation of some of the embodiments of this invention in a casino or electronic gaming machine ("EGM"), one or more devices may be programmed to play various embodiments of the invention. The concepts and embodiments described herein may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the principles described herein is illustrated in FIG. 2.

Hardware, firmware, software or any combination thereof may be used to perform the various gaming functions, display presentations and operations described herein. The functional modules used in connection with the disclosure may reside in a gaming machine as described, or may alternatively reside on a stand-alone or networked computer. The representative computing structure 200 of FIG. 2 is an example of a computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions described herein includes a processor, such as depicted by the representative central processing unit (CPU) 202, coupled to memory, such as random access memory (RAM) 204, and some variation of read-only memory (ROM) 206 or other persistent storage. The ROM 206 may also represent other types of storage media to store programs, such as programmable ROM (PROM), erasable PROM (EPROM or any technology capable of storing data). The processor 202 may communicate with other internal and external components through input/output (I/O) circuitry 208 and bussing 210, to communicate control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to one or more displays 211, which represent a manner in which the gaming activities may be presented. The display 211 represents the "presentation" of the game information in accordance with the disclosure, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, inputting data to identify a player for a player loyalty system, etc. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG) or other random generator. The fixed and dynamic symbols generated as part of a gaming activity may be produced using one or more RNGs. RNGs may be implemented using hardware, software operable in connection with the processor 202, or some combination of hardware and software. The principles described herein are operable using any known RNG, and may be integrally programmed as part of the processor 202 operation, or alternatively may be a separate RNG controller 240 that may be associated with the computing arrangement 200 or otherwise accessible such as via a network. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server(s) 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 or other processor(s) indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 may also be provided in gaming machine embodiments, where the payment device 244 serves as the mechanism providing the payout to the player or participant. In some embodiments, the payment device 244 may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency or asset. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, or any other player assets, for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payment device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described herein. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a pay table. The software 232 may include instructions to provide other functionality as known in the art or as described and shown herein.

The systems, apparatuses and methods operable via these and analogous computing and gaming devices can support gaming features as described herein. In a representative slot game embodiment, one, more or all reels are presented with a respin cost after an initial reel spin. As described herein, the calculation can be streamlined to avoid inefficiencies and delays that can adversely impact play of the game. Embodiments in which respin costs are calculated are independent of the order of symbols on the reel providing the replacement symbols, and solutions described herein obviate any need to rigorously analyze every reel stop position to determine costs to respin a reel.

Many embodiments may be described in terms of a slot game, where symbols are matched on paylines to determine payout awards. However, the principles described herein are equally applicable to other games of chance, as described herein and as will be readily apparent to those skilled in the art from the teachings herein. In a slot game embodiment, for example, players can purchase the ability to respin one of the reels at the time of their choice. According to other embodiments and variations, players may be able to buy the ability to respin any of the reels, buy the right to spin one, two, or more of the reels, buy the right to certain number of respins for a single a reel (or dispersed among multiple reels). In other embodiments, this ability may be tied to receiving a predefined number of subsymbols, which may be shown in a meter with a threshold level to being eligible for one or more respins.

In other embodiments, the respin of a reel may include using a different reel strip to increase the odds of getting a desirable symbol, such as wild, a bonus symbol, or even dynamically determining what symbols would help the game outcome the most and adding more of those symbols to the new re-spin reel strip. In other embodiments, one or more of the reels may be automatically respun by gaming device if it is best strategy.

In still other embodiments, upon completion of a spin, for each qualifying reel, the player is presented with a price to respin that reel. The qualifying criteria could be expected value (EV) of that reel respin, symbols adjacent to that reel, symbols present on that reel, or any other criterion deemed interesting. The use of criteria is optional, and one embodiment would be to show all prices for all reels after every spin. The prices of the reels may be calculated dynamically after each spin. They also may be calculated by a solver and stored in a lookup table, or via any other method deemed appropriate. The number of respins available after each spin may or may not be limited. Another variation includes enriching the reel strips being respun, or changing them in any way deemed appropriate. This dynamic pricing in some embodiments may be available on one, all, or any subset of the reels.

The following description and accompanying drawings set forth numerous representative embodiments that facilitate an understanding of the inventive concepts and disclosure provided herein.

Figure 3:
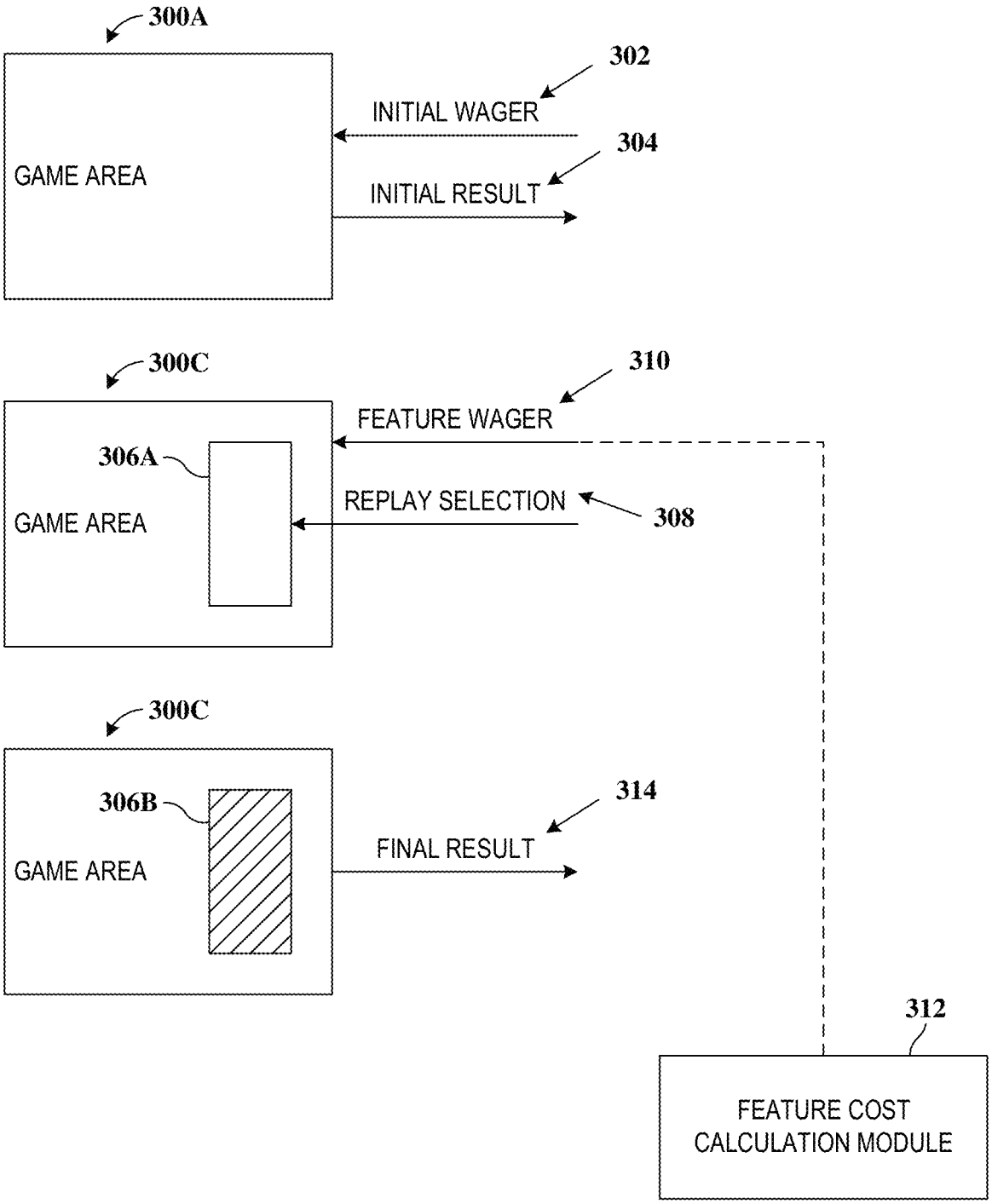
FIG. 3 is a block diagram illustrating one embodiment of a game replay feature where some subset of a gaming activity is allowed to be replayed to provide another game result.

FIG. 3 is described in the context of such a slot game embodiment. This embodiment depicts a reel or symbol location(s) respin option in the context of a slot game. Game area 300A represents the space in which the game is presented for play, such as an array of symbol locations or display elements in a slot game grid, a presentation area for one or more poker hands, etc. In such games, there may be an initial wager 302 to participate in the gaming activity conducted in the game area 300A, and an initial result 304 which represents a payout(s), if any, resulting from participation in the gaming activity conducted at the game area 300A.

In accordance with embodiments described herein, one or more symbol locations, display elements, reels, poker hands, or other subset of the gaming activity may be replayed. For example, game area 300B identifies a section 306A of the game area, relating to some subset of the game elements involved in play of the game. For example, the section 306A may represent one or more symbol locations, such as a reel, in a slot game. Replay selection 308 identifies what section 306A of the game area 300B that the player is electing to replay. In order to enable the player to select replay 308 a section 306A, some embodiments involve the player making an additional wager(s) to be permitted to replay 308 some section 306A of the game area 300B. Thus, the player may provide a feature wager 310 in order to be permitted to participate in the replay feature. As is described in greater detail below, a feature cost calculation module 312 is utilized to calculate the amount of the feature wager 310 for the particular section 306A for the players replay selection 308 based on the current game situation of the game area 300B. For example, in a slot game, the feature wager 310 may be calculated by the feature cost calculation module 312 to be higher where the current game situation involves respinning a reel that could provide a relatively large payout, versus a feature wager 310 that may be calculated by the feature cost calculation module 312 to be lower where the current game situation involves respinning a reel that would provide only a modest, and lower, payout.

Upon receiving the feature wager 310, the game section 306B depicted at subsequent game area 300C changes, such as a result of respinning a reel identified by the players replay selection 308. When the reel or other symbol location(s) have been respond, or otherwise replayed, the game area 300C will most likely conclude in a different gaming result, shown in FIG. 3 as the final result 314. Therefore, the final result 314 corresponds to one or more payouts that may result in the game area 300C when a game section 306B has been replayed (e.g., provided new/updated symbols or other items involved in the game play) as a result of the players replay selection 308. It should be noted that some embodiments may bypass any player replay selection 308, and automatically grant the player a respin or other replay of one or more game sections 306A to provide the player with another opportunity to fulfill a payline(s) and/or otherwise better their final result 314.

Figure 4:
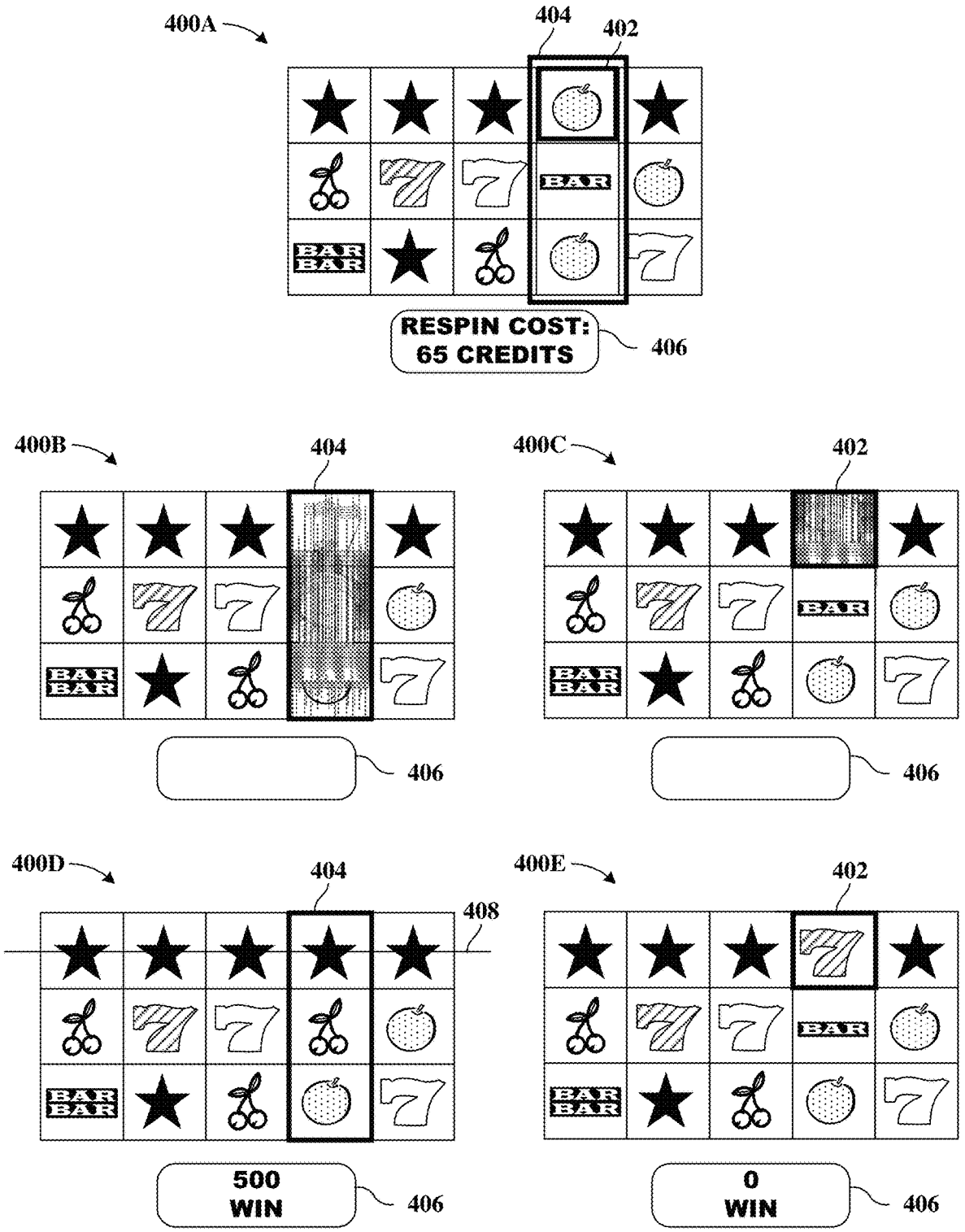
FIG. 4 is an example of a sequence of slot game reel spins, that illustrate a symbol replay feature as described herein.

FIG. 4 is an example of a sequence of slot game reel spins, that illustrate a symbol replay feature as described herein. The slot game grid 400A includes a plurality of symbol locations arranged in an array. In one embodiment, one or more discreet symbol locations 402 may be replayed, whereby the original symbol at the respective one or more symbol locations is updated with another symbol. In another embodiment, groups 404 of two or more symbols may be collectively replaceable, such as by allowing one or more slot game reels to be respun. In the example of FIG. 4, slot game grid 400A, notification of the cost to respin the symbol location 402, or reel 404, or other subset of the game grid 400A, may be presented to the player such as via display window 406. The cost to respin a symbol location(s) 402 and/or reel 404 or other subset of symbols is calculated based on, in one embodiment, the current situation of the game which may include the symbols surrounding the area to be replayed (e.g., the potential symbol combinations based on symbols outside the replay subset 402/404 and the possibility of receiving certain symbols in the replayed subset 402/404).

Slot grid 400B depicts an embodiment where the player was allowed to, and elected to, respin a reel 404. Slot grid 400C depicts an alternative embodiment where the player was allowed to, and elected to, respin a symbol location 402. Results of these representative, alternative embodiments of respinning a reel at slot grid 400B and respinning a symbol location(s) 402 are depicted at slot grid 400D and 400E respectively. In the example of slot grid 400D, respinning reel 404 resulted in three new symbols being presented on reel 404, the top one being a star symbol, thereby completing a string of five consecutive star symbols on payline 408, which in this example provides a payout of 500 credits as depicted at display window 406. In the example of slot grid 400E, respinning symbol location 402 resulted in one new symbol being presented at symbol location 402, namely being a variation of a "7" symbol. In the embodiment of slot grid 400E, respinning the symbol location 402 did not result in a winning payout (as noted at display window 406 associated with slot grid 400E) as a result of the symbol upgrade, although the player received a chance to do so by purchasing that option.

FIGS. 5A-5D depict a representative sequence of gaming events, in particular slot game reel spins, that provide a respin feature as described herein. This example assumes a plurality of symbols labeled S1, S2, S3, S4, S5, S6, S7, S8 and S9, although more or less symbols may be utilized. This embodiment assumes a number of paylines which may include adjacent symbol locations and/or other configurations of symbol locations having one or more intermediate symbol locations. For purposes of this example, winning payline indicators are provided to depict where in the slot grid the payout occurs, such as payline indicator 502 associated with grid 500A of FIG. 5A.

Figure 5A:
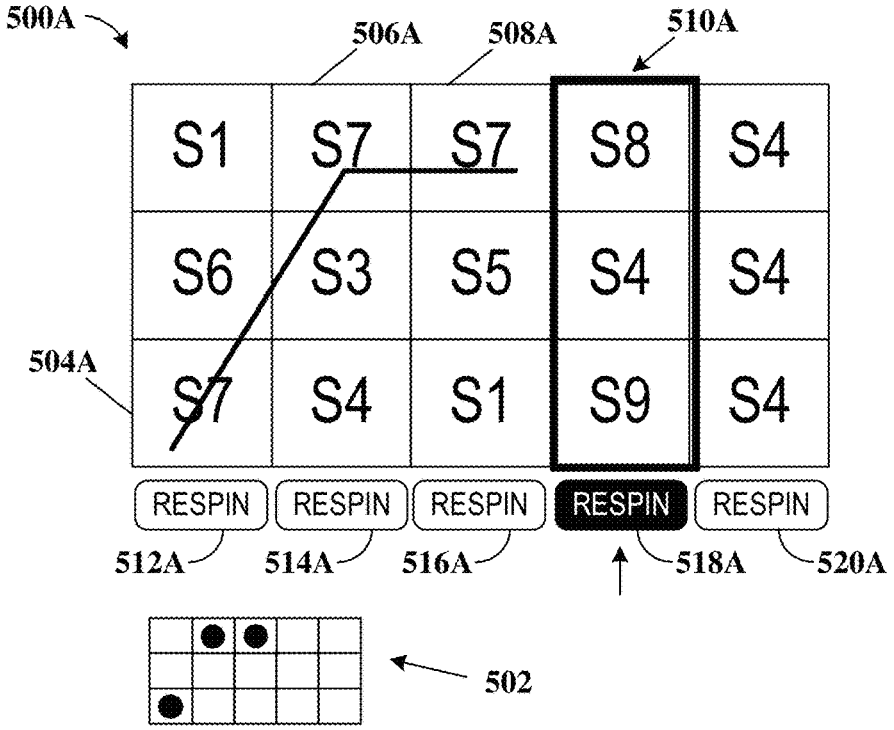
FIGS. 5A-5D depict a representative sequence of slot game reel spins that provide a representative respin feature.

FIG. 5A depicts a slot game grid 500A after a reel spin, where a 3-symbol payout for symbol S7 has occurred (referred to herein as an S7 3-pay), due to S7 symbols at symbol locations 504A, 506A, 508A which is a defined payline for the particular game as noted at payline indicator 502. In this example, it may be beneficial for the player to respin reel 510A in order to further extend the number of S7 symbols on one or more paylines. In one embodiment, the player is allowed to respin any reel using some user interface, such as respin buttons 512A, 514A, 516A, 518A, 520A. In other embodiments where one or more individual symbol locations may be replayed/respun, other user interface mechanisms may be provided to specifically identify the one or more symbol locations to be replayed.

Figure 5B:
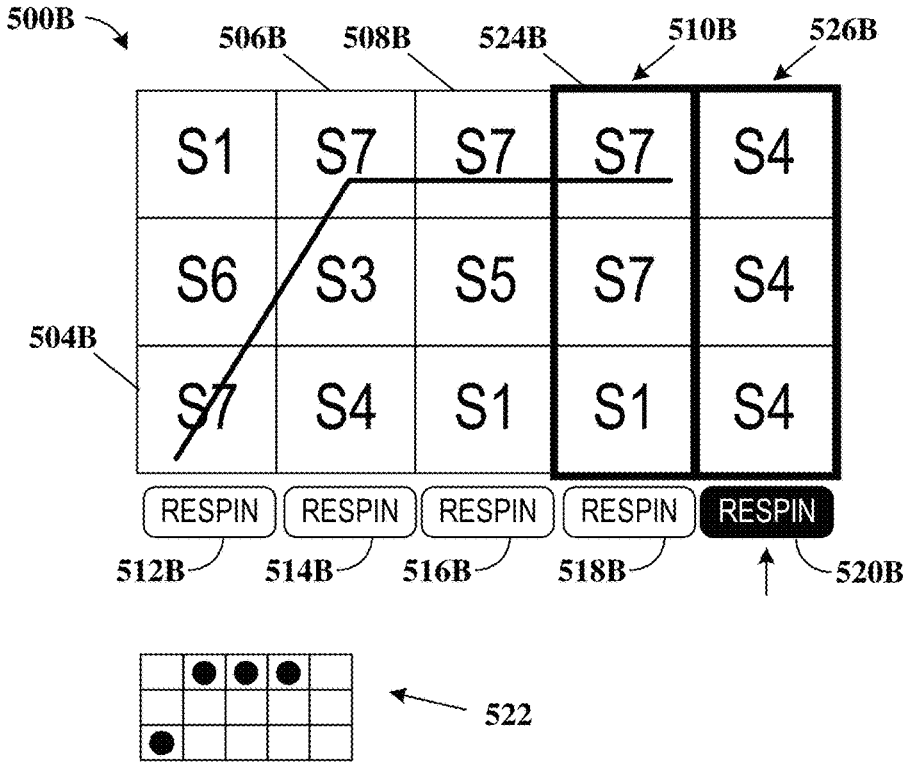

In the example of FIG. 5A, the player chooses to respin reel 510A by selecting user interface 518A. As shown at FIG. 5B, the reel 510B has changed symbols from S8, S4, S9 to S7, S7, S1 (from top down). As an established payline corresponds to the payline indicator 522, and since the respun reel 510B resulted in an S7 symbol at symbol location 524B, the player has now obtained a 4-symbol payout for symbol S7 (i.e. S7 4-pay), which is an improvement from a payout perspective from the pre-respin S7 3-pay of FIG. 5A.

As shown at FIG. 5B, the player may continue to purchase reel respin opportunities, as depicted by the player selecting respin button 520B to respin reel 526B. The player may choose to respin reel 526B to further extend the number of S7 symbols on one or more paylines. The result is shown at grid 500C of FIG. 5C, where the player has obtained an S7 symbol at symbol location 528C, thereby satisfying a 5-symbol payout for symbol S7 (S7 S-pay) on an established payline depicted by payline indicator 530. Again, this proved to be an improvement from a payout perspective from the pre-respin S7 4-pay of FIG. 5B.

Figure 5C:
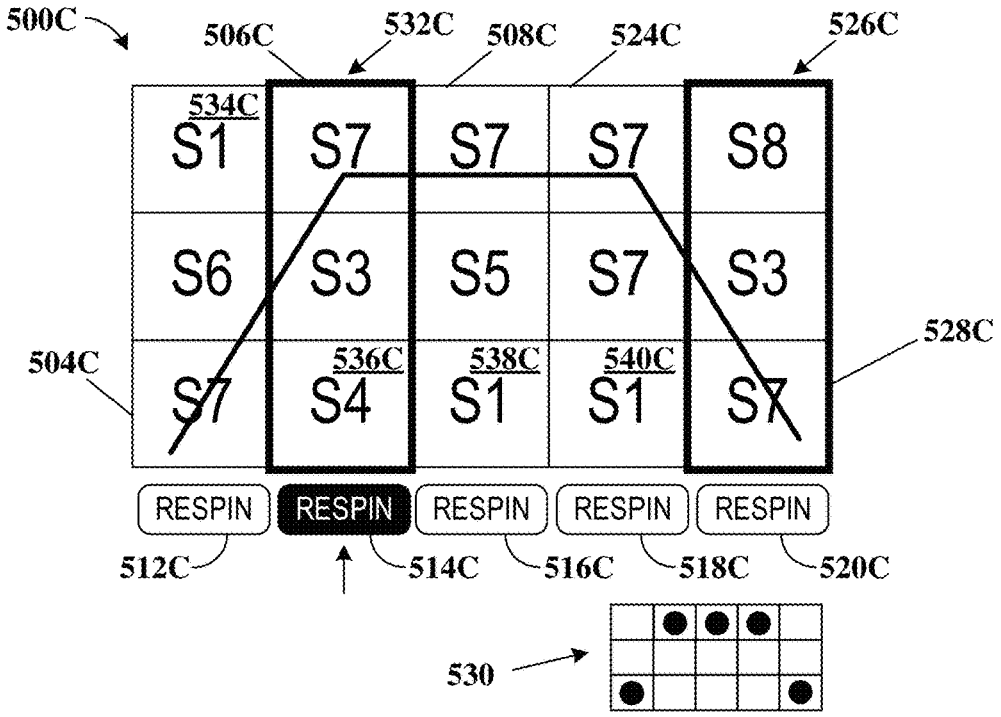
Figure 5D:
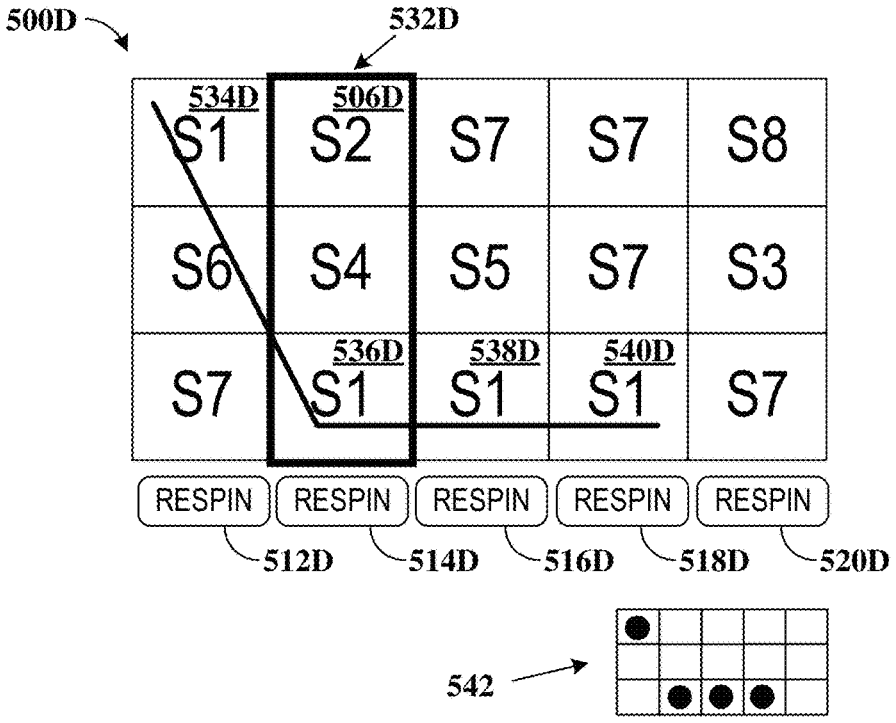

As shown at FIG. 5C, the player may continue to purchase reel respin opportunities, as depicted by the player selecting respin button 514C to respin reel 532C. In this example, the player has reviewed the grid 500C, and noticed that if an S1 symbol were to occur at a correct position on the reel 532C, an S1 4-pay (i.e. four S1 symbols along a payline) would result, such as by way of symbol locations 534C, 536C, 538C, 540C. Thus, the player opts to respin reel 532C by selecting the appropriate respin user interface 514C, resulting in the slot grid 500D of FIG. 5D. A payline is available that corresponds to the payline depicted at payline indicator 542. When reel 532C of grid 500C (FIG. 5C) was respun to provide reel 532D of grid 500D (FIG. 5D), an S1 symbol was presented at symbol location 536D, thereby providing an S1 4-pay (i.e. four S1 symbols along a payline, as shown at payline indicator 542).

As illustrated by the representative example of FIGS. 5A-5D, some embodiments enable a player to repeatedly respin one (and in some embodiments more than one) reel to attempt to better their result and payout from playing the game.

As noted in connection with FIG. 3, a feature cost calculation module 312 or other such manner of calculating a cost to respin symbol locations and/or reels may be implemented. A processor may be configured with software to perform such functions, to provide a hardware-configured manner of calculating such respin costs.

In one embodiment, a respin cost can be calculated by cycling through an entire reel of symbols for the symbol location or reel to be respun, determining the potential payouts for each reel position, and calculating a cost based on what the player could potentially win. However, such a methodology is a labor-intensive and time-consuming process that makes enabling reel respins a slow and undesirable process. For at least these reasons, an improved manner of calculating costs for respinning symbol locations, reels, and/or other symbol groups is desirable. The present invention provides solutions to this and other shortcomings of enabling reel respins or other gaming replays.

In accordance with one embodiment, the value of respinning a particular one of the reels or symbol locations involves evaluating each symbol type rather than each individual reel stop. For example, a particular symbol type (e.g., a particular one of the available symbols on the reel strip) is assumed to be positioned in each of the symbol locations of the reel being respun that is in the playable slot game grid. Potential winning payouts on the playable/visible grid are then determined for that symbol type, and then an analogous determination is made for other symbol types available on the reel strip for the replaced reel. Based on the potential winning payouts for each symbol type on the visible reel, a calculation of the cost to respin that reel may be determined. This is accomplished without having to make a determination at every reel stop, which is an inefficient and undesirable manner to calculate reel respin costs that can be detrimental to such a game feature.

Various manners for determining the cost of a respin are described herein. In one embodiment, upon completion of a reel spin, for each qualifying reel, the player may be presented with a price to respin that reel. The qualifying criteria could be EV of that reel respin, the symbols or state of the symbols adjacent to or otherwise in the vicinity of that reel, symbols present on that reel, or any other criterion desired. The use of such criteria is optional in one embodiment, as other embodiments involve the player indicating a desire to respin a particular reel(s), while still other embodiments involve showing all respin costs for all reels after every spin, etc.

In one embodiment, the reel respin costs may be calculated dynamically after each spin. They also may be calculated by a solver and stored in a lookup table, or via any other method deemed appropriate. The number of respins available after each spin may or may not be limited. Dynamic pricing may be available on one, all, or any subset of the reels.

In another embodiment, the reel strips being respun are "enriched" such that they have, for example, more and/or higher value symbols, or more symbols relating to those already on the grid. Therefore, the reel strips associated with reels that are respun may be identical to the reel already used, or different from the reel already used in symbols, symbol count, etc.

Figure 6:
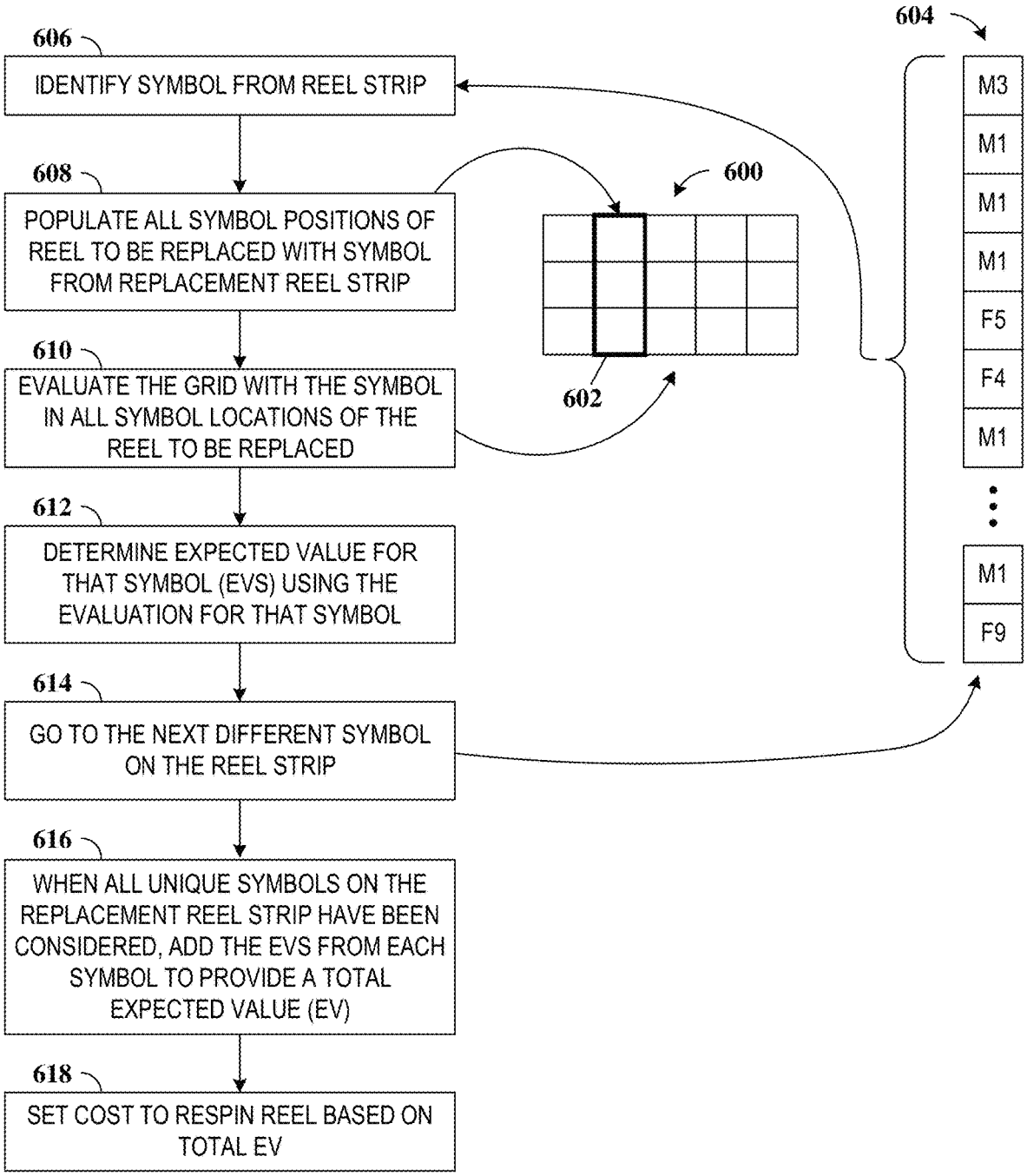
FIG. 6 is a block diagram of a representative manner for determining reel respin costs in accordance with the disclosure.

FIG. 6 is a block diagram of a representative manner for determining reel respin costs in accordance with the disclosure. A slot grid 600 includes a plurality of symbol locations, the number of which depends on the particular slot game. Assuming a populated grid 600, the player may choose to respin a reel 602. In other embodiments, multiple reels and/or symbol locations may be respun/replayed. Replacement reel strip 604 represents the available symbols to replace those on the reel 602, and may be any size and have any number of symbols desired.

The calculation of the respin cost involves identifying 606 a first symbol from the replacement reel strip 604, which may correspond to the original reel strip or may have different symbols, numbers of symbols, etc. than the original reel strip. For example, the M3 symbol at the top of the reel strip 604 may be considered first. All symbol positions of the reel 602 available/visible on the grid 600 are populated 608 with the first symbol of the replacement reel strip 604. The grid 600 is evaluated 610 with the symbol in all symbol locations of the reel 602 to be replaced. The expected value for that symbol (EVS) is determined 612 for the grid 600 when that symbol has populated 608 the reel 602. This is based on a paytable (not shown) that provides payout information for symbol combinations of different lengths. When the EVS for the grid using a particular symbol has been determined, the analysis will go 614 to the next different symbol on the replacement reel strip 604. For example, the M1 symbol may be considered next.

In one embodiment, calculating the expected value for a symbol refers to calculating the expected value on the grid when the reel to be replaced is populated with the particular symbol at issue. In other words, payouts anywhere on the grid may contribute to the EVS for the case when a particular symbol populates the reel to be replaced, not only payouts involving that particular symbol. Thus, while some embodiments may calculate the EVS for a particular symbol using only payouts involving the symbol of type T that has temporarily populated the reel to be replaced for purposes of analysis, other embodiments calculate the EVS for that particular symbol using any payout on the grid when the symbol of type T is temporarily populating the reel to be replaced.

This process continues for all unique/different symbols on the replacement reel strip 604. When all unique symbols on the replacement reel strip 604 have been considered, the EVS' from each symbol are added 616 together to provide a total expected value (EV) representing the player's expected return if the player chooses to respin reel 602 under these circumstances. The cost to respin the reel 602 is then set 618 based on the total EV. For example, the cost may be set to equal the EV, or may be set higher than the EV to shift the balance away from the player (e.g., to provide higher returns to the slot machine/casino), or may be set lower than the EV to shift the balance towards the player. In one embodiment, the respin cost is set to an amount higher than the calculated total EV by an amount substantially commensurate with a payout percentage for the particular slot game.

Figure 7:
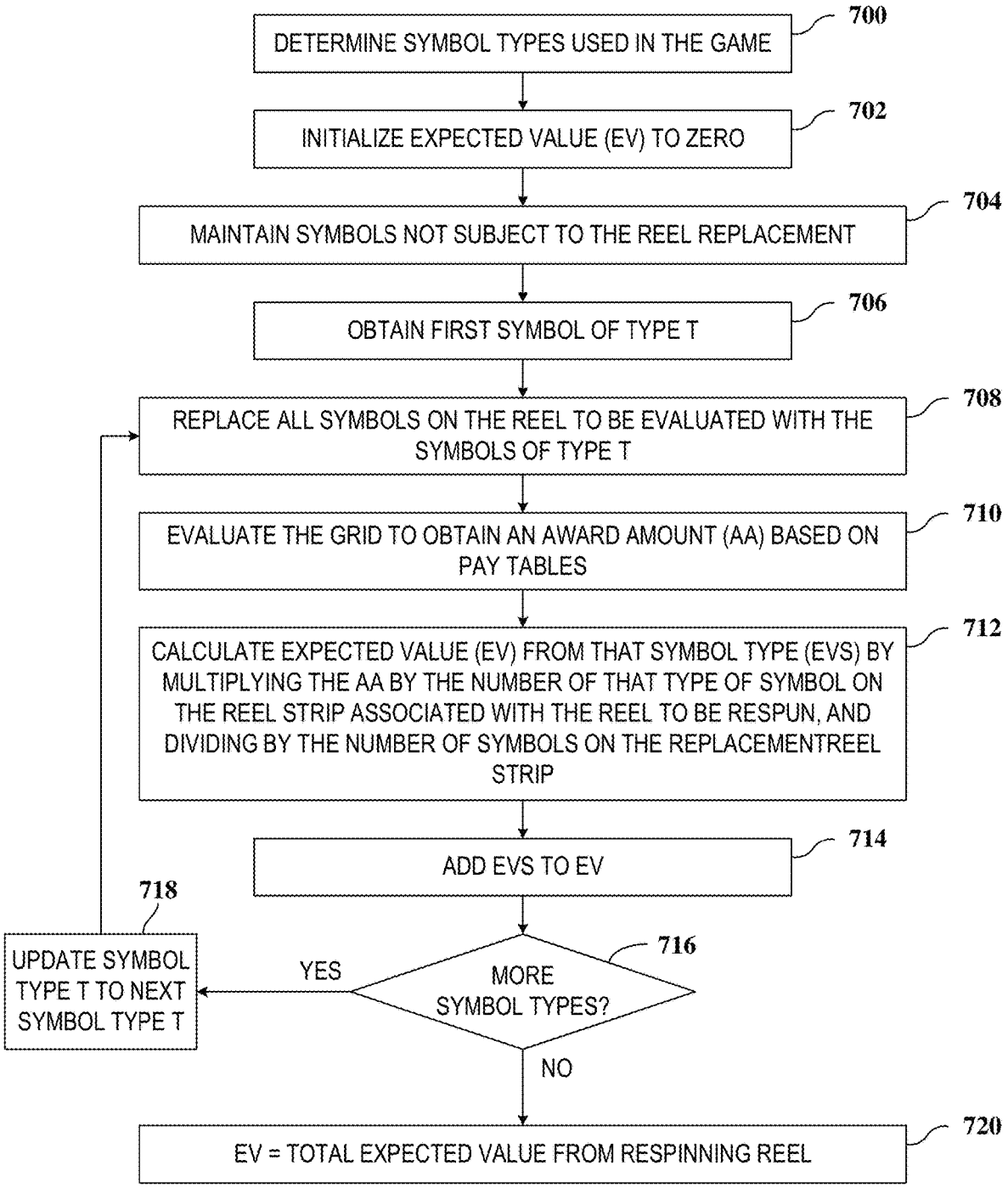
FIG. 7 is a flow diagram illustrating one representative manner for determining respin costs to respin reels in a slot game.

FIG. 7 is a flow diagram illustrating one representative manner for determining respin costs to respin reels in a slot game. The symbol types using the game are determined 700. For example, each of the different distinct symbols on the replacement reel are identified. A calculation is ultimately made to determine the expected value (EV) from respinning the reel, where the EV represents the expected return to the player if the reel is respun, and from which the purchase cost to respin the reel may be based. The EV is initialized 702 to zero in one embodiment, although it may be set to some other number to create an offset in the EV that may tilt in favor or against the player.

The calculation assumes that symbols not subject to the reel respin will remain in their current positions resulting from the initial reel spin. In other words, symbols not subject to the reel replacement are maintained 704 in the state they were presented on the original reel spin. The first symbol of type "T" is obtained 706 from the replacement reel strip to be analyzed. In one embodiment, each unique or distinct symbol on the replacement reel strip corresponds to a different symbol type "T," such that a first symbol S1 represents a first symbol type T, a second symbol S2 represents a second symbol type T, and so forth.

All symbols on the reel to be evaluated are replaced 708 with the obtained 706 symbol of type T. In this state, the visible reel to be replaced on the slot grid is populated with the symbol of type T in each of the symbol locations. When these symbol locations have been populated with the same symbol of type T, the slot grid is again evaluated 710 to obtain an award amount (AA) based on pay tables. The grid's expected value is calculated 712 from that symbol type (EVS) by multiplying the award amount by the number of that type of symbol on the replacement reel strip associated with the reel to be respun, and dividing by the number of symbols on the replacement reel strip. This calculated 712 EVS for the particular symbol at issue is added 714 to the existing EV, as the total of the EVS ultimately makes up the expected value (EV) being sought.

If it is determined 716 that there are more distinct symbol types on the replacement reel strip, then the symbol type T is updated 718 to the next symbol type T, and all symbols on the reel to be evaluated are replaced 708 with the new symbol of type T. The process 708, 710, 712, 714, 716, 718 continues until it is determined 716 that there are no more symbol types on the replacement reel strip. The sum of the EVS values for each distinct symbol on the replacement reel strip constitutes the EV, representing the total expected value 720 from respinning the reel. The cost to respin the reel is based on this EV, and can then be made available to the player in the decision as to whether or not to purchase the ability to respin that reel.

Figure 8:
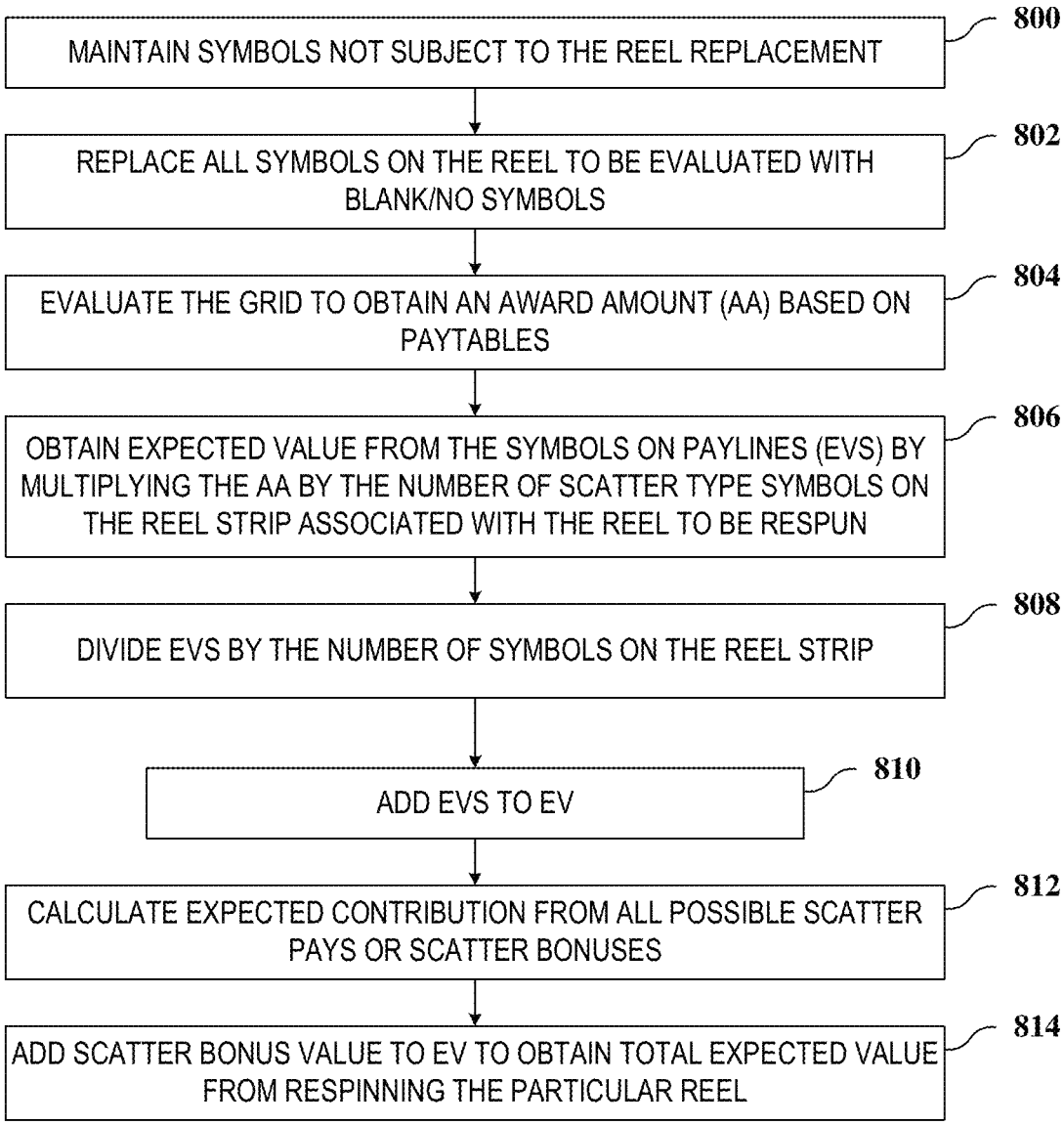
FIG. 8 depicts an example of addressing the possibility of a scatter pay in conjunction with a payline-based calculation of FIG. 7

A different calculation may be implemented for special situations, such as for payouts obtained via obtaining a single award symbol, payouts obtained by symbol combinations not on paylines (e.g., scatter pays where a predetermined number of certain symbols presented anywhere on the play grid may provide a payout and/or initiate a bonus event), etc. FIG. 8 depicts an example of addressing the possibility of a scatter pay in conjunction with a payline-based calculation of FIG. 7. In such a situation, the determining 700 of symbols for the payline-based calculation of FIG. 7 would involve identifying each of the different distinct symbols on the replacement reel that are not scatter symbols. The embodiment of FIG. 8 allows the expected value (EV) of scatter pays or scatter bonuses to be added to the total calculated expected value 720 of FIG. 7.

The symbols not subject to the reel replacement are maintained 800. For example, the slot grid is initially populated with symbols, and those symbols and positions are maintained 800 with the exception of those symbols associated with the reel to be respun. In this embodiment, all symbols on the reel to be evaluated are replaced 802 with blank symbols, or alternatively the symbols on the reel can be disregarded until an analysis of the payline payouts associated with the remaining symbol locations is determined. Thus, the grid, without regard to the reel to be replaced, is evaluated 804 for payline payouts to obtain an award amount (AA) based on pay tables. The expected value from the symbols on paylines (EVS) is obtained 806 by multiplying the AA by the number of scatter type symbols on the reel strip associated with the reel to be respun, which is then divided 808 by the number of symbols on the reel strip. The EVS is added 810 to the expected value (EV). Then, the expected contribution from all possible scatter pays or scatter bonuses is calculated 812, and added 814 to the EV to obtain the total expected value from respinning the particular reel.

Figure 9B:
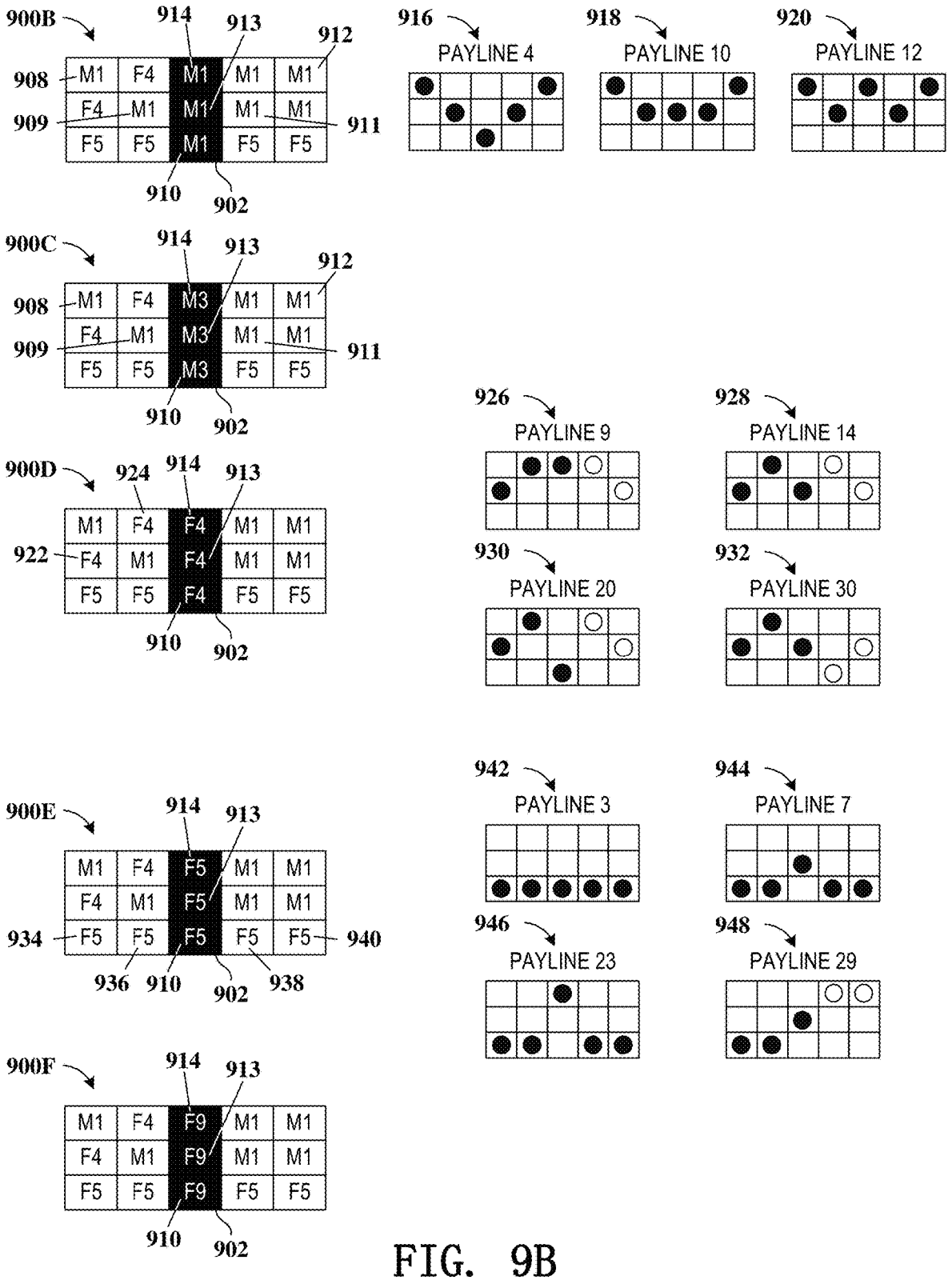

FIGS. 9A-9B depict an example for calculating slot game respin costs in accordance with one embodiment. For purposes of this example, it is assumed that the player is playing a slot game with a 3×5 slot grid (3 rows by 5 columns/reels), and receives a populated slot grid 900A as a result of a reel spin. The player decides to respin the third reel 902. This decision may be based on, for example, the pay tables and paylines (or other payout methodologies) for the particular game.

Referring to representative paytable 904 for this example (which may represent the entire game's paytable or a portion thereof), an M1 symbol provides a payout of 5 units (e.g., 5 credits) where three M1 symbols are presented on a payline (in a payline-based embodiment) or one of each M1 symbol anywhere in the first three reels (in a multiway-based embodiment) or other desired symbol combination methodology. Similarly, an established combination of four M1 symbols provides a payout of 10 units, and an established combination of five M1 symbols provides a payout of 25 units. In an analogous manner, combinations of F4 symbols provides payouts of 3, 5 and 10 units for combinations of 3, 4 and 5 respectively, while combinations of F5 symbols provides payouts of 1, 2 and 3 units for combinations of 3, 4 and 5 respectively.

Also assumed for this example are a plurality of established paylines, although a multiways or other payout methodology may be implemented. The established paylines for this example are shown in the payline table 906, where thirty paylines can provide a payout. For purposes of this example, it is assumed that a payout will be provided for any symbol combination having at least three or more matching symbols from, in this example, left to right beginning with the first (leftmost) column. It should be recognized that the principles described herein are equally applicable to payout styles that are not only left-to-right, but could be used for dynamically-generated paylines in any direction, right-to-left configurations, etc. The numbers in the grid for payline table 906 represent row positions for the symbol. For example, for payline table 906, on payline 1, a payout would be provided for three consecutive matching symbols in columns 1, 2 and 3 along row 2. On payline 25, a payout would be provided for four consecutive matching symbols in columns 1, 2, 3 and 4 on rows 3, 1, 1, 1. On payline 15, a payout would be provided for five consecutive matching symbols in columns 1, 2, 3, 4 and 5 on rows 2, 3, 2, 3, 2, and so forth. An additional assumption for purposes of this example is that the reel strips, or at least the reel strip associated with reel 902, includes symbols, in this order: M3, M1, M1, M1, F5, F4, M1, M1, F9.

An example is provided given these assumptions, but it should be recognized that the principles described herein are equally applicable to any desired paylines, number of matching symbols per payline, multiways payouts, etc.

Based on the initial reel spin shown at grid 900A, the player received no payouts based on the paytable 904. Given the assumptions above, the player chooses to respin reel 902, hoping to obtain at least an M1 symbol at symbol location 910, which would satisfy a M1 S-pay (i.e. five M1 symbols along payline 4 (i.e. M1 symbols in rows 1, 2, 3, 2, 1 in columns 1, 2, 3, 4, 5 respectively) of payline table 906, which would provide a 25 credit payout pursuant to paytable 904. Particularly, M1 symbols are already positioned in symbol locations 908, 909, 911 and 912, and if the M3 symbol at symbol location 910 could receive an updated M1 symbol, it would result in a 25-credit payout on payline 4.

To enable the player to respin a desired reel(s), the player will pay some amount to obtain the opportunity to respin the desired reel(s). In accordance with the disclosure, an efficient manner of calculating the cost to purchase a respin of a particular reel is provided. For purposes of this example, processes such as those described in connection with, for example, FIGS. 6 and 7, are utilized to calculate respin costs.

Therefore, the symbol used in this particular game are identified, which are M1, M3, F4, F5 and F9 in this example (identified from the representative reel strip for this example, with symbols in the order M3, M1, M1, M1, F5, F4, M1, M1, F9). Each of these identified symbols M1, M3, F4, F5 and F9 are independently filled into the visible/playable symbol locations 914, 913, 910 of the reel 902 symbols to be replaced.

For example, referring to FIG. 9B, a first of the symbols (symbol type T) is used to fill all symbol locations 910, 913, 914, and the grid 900B is evaluated to determine an award amount (AA) based on the paytable 904 and payline table 906. With the M1 symbol being the first symbol type (T) used to populate the reel 902, three of the thirty paylines of the payline table 906 have achieved a payout, including an M1 5-pay on payline 4 (i.e. M1 symbols at symbol locations 908, 909, 910, 911, 912 for a 25-credit win pursuant to paytable 904), an M1 5-pay on payline 10 (i.e. M1 symbols at symbol locations 908, 909, 913, 911, 912), and an M1 5-pay on payline 12 (i.e. M1 symbols at symbol locations 908, 909, 914, 911, 912). For ease of identifying these three winning symbol combinations, the winning paylines are also replicated at symbol positions for paylines 4, 10 and 12 on winning payline grids 916, 918 and 920 respectively.

As all three of the paylines have symbol combination lengths of five, then according to paytable 904, each provides a 25-credit payout, for a total of 75 credits as the award amount (AA) for the first grid 900B which filled the replacement reel 902 with M1 symbols. Since there are nine symbols on the reel strip in this example (i.e. M3, M1, M1, M1, F5, F4, M1, M1, F9), the expected value for the M1 symbol (EVS) is calculated by multiplying the AA of 75 credits by the number of M1 symbols on the reel strip, and dividing that number by the number of symbols on the reel strip. In this example, the calculation results in an EVS of 41.66 (i.e. [75×5]/9=41.66). This 41.66 is then added to the overall expected value (EV), which was initially reset to zero, so with consideration of only the M1 symbol, the EV would currently be equal to 41.66.

The next symbol on the reel strip that is used on the respin reel 902 is now considered, which in this example is an M3 symbol, of which there is only one on the example reel strip (i.e. M3, M1, M1, M1, F5, F4, M1, M1, F9). Therefore, the reel 902 to be replaced is now populated with the M3 symbol, as depicted at grid 900C. With the M3 symbol being the second symbol type (T) used to populate the reel 902, zero of the thirty paylines of the payline table 906 have achieved a payout when consulting the payline table 906 of FIG. 9A. Therefore, the award amount (AA) is zero, and the EVS for the M3 symbol is zero. The running EV therefore remains the same, 41.66 after the M1 and M3 symbols have been considered.

The next symbol on the reel strip that is used on the respin reel 902 is now considered, which in this example is an F4 symbol, which is populated into symbol locations 910, 913, 914 of grid 900D. Four of the thirty paylines of the payline table 906 have achieved a payout, including an F4 3-pay on payline 9 (i.e. F4 symbols at symbol locations 922, 924, 914 for a three credit win pursuant to paytable 904), an F4 3-pay on payline 14 (i.e. F4 symbols at symbol locations 922, 924, 913 for three credits), an F4 3-pay on payline 20 (i.e. F4 symbols at symbol locations 922, 924, 910 for three credits), and an F4 3-pay on payline 30 (i.e. F4 symbols at symbol locations 922, 924, 913 for three credits). For ease of identifying these four winning symbol combinations, the winning paylines are also replicated at symbol positions for paylines 9, 14, 20 and 30 on winning payline grids 926, 928, 930 and 932 respectively, where unfilled/white circles represent a remainder of the respective payline where F4 symbols were not present.

As all four of the paylines have symbol combination lengths of three, then according to paytable 904, each provides a 3-credit payout, for a total of 12 credits as the award amount (AA) for the grid 900D which filled the replacement reel 902 with F4 symbols. Since there are nine symbols on the reel strip in this example (i.e. M3, M1, M1, M1, F5, F4, M1, M1, F9), the expected value for the F4 symbol (EVS) is calculated by multiplying the AA of 12 credits by the number of F4 symbols on the reel strip, and dividing that number by the number of symbols on the reel strip. In this example, the calculation results in an EVS for the F4 symbol of 1.33 (i.e. [12×1]/9=1.33). This 1.33 is then added to the overall expected value (EV), which after consideration of the M1 and M3 symbols was 41.66, for a new EV total of 43 (41.66+1.33).

The next symbol on the reel strip that is used on the respin reel 902 is now considered, which in this example is an F5 symbol, which is populated into symbol locations 910, 913, 914 of grid 900E. Four of the thirty paylines of the payline table 906 have achieved a payout, including an F5 5-pay on payline 3 (i.e. F5 symbols at symbol locations 934, 936, 910, 938, 940 for a three credit win pursuant to paytable 904), an F5 5-pay on payline 7 (i.e. F5 symbols at symbol locations 934, 936, 913, 938, 940 for three credits), an F5 5-pay on payline 23 (i.e. F5 symbols at symbol locations 934, 936, 914, 938, 940 for three credits), and an F5 3-pay on payline 29 (i.e. F5 symbols at symbol locations 934, 936, 910 for one credit). For ease of identifying these three winning symbol combinations, the winning paylines are also replicated at symbol positions for paylines 9, 14, 20 and 30 on winning payline grids 942, 944, 946 and 948 respectively, where unfilled/white circles represent a remainder of the respective payline where F5 symbols were not present.

Three of the four winning combinations from the F5 symbol are five symbols in length (paylines 3, 7 and 23), and one is three symbols in length (payline 29). According to paytable 904, each of the winning payouts having five like symbols (paylines 3, 7 and 23) pays 3 credits, and one winning payout having three like symbols (payline 29) pays 1 credit, for an AA of 10 credits. Since there are nine symbols on the reel strip in this example (i.e. M3, M1, M1, M1, F5, F4, M1, M1, F9), the expected value for the F5 symbol (EVS) is calculated by multiplying the AA of 10 credits by the number of F5 symbols on the reel strip, and dividing that number by the number of symbols on the reel strip. In this example, the calculation results in an EVS for the F5 symbol of 1.11 (i.e. [10×1]/9=1.11). This 1.11 is then added to the overall expected value (EV), which after consideration of the M1, M3, and F4 symbols was 43, for a new EV total of 44.11 (43+1.11).

The last symbol on the reel strip that is used on the respin reel 902 is now considered, which in this example is an F9 symbol, of which there is only one on the example reel strip (i.e. M3, M1, M1, M1, F5, F4, M1, M1, F9). Therefore, the reel 902 to be replaced is now populated with the F9 symbol, as depicted at grid 900F. With the F9 symbol being the symbol type (T) used to populate the reel 902, zero of the thirty paylines of the payline table 906 have achieved a payout when consulting the payline table 906 of FIG. 9A. Therefore, the award amount (AA) is zero, and the EVS for the F9 symbol is zero. The running EV therefore remains the same, 44.11, after the M1, M3, F4, F5 and F9 symbols have all been considered.

This process would continue for any symbols on the reel strip that will provide the updated symbols resulting from the reel spin. Therefore, if there were twenty unique symbols on the reel 902, the process would be completed for each of those twenty symbols, and a total EV calculated.

The expected value (EV) is computed by adding each type's value, as described above. The total EV represents the player's expected return, which in this example is 44.11 credits, if the player respins reel 902 in this example. The calculation would differ based on the initial symbol population, number of different symbol types on the replacement reel, number of symbols on the replacement reel, defined payouts for symbol combinations, etc. Based on this expected return, a cost to respin the reel may be determined. In one embodiment, the cost to respin the reel may be set to equal the expected value (EV) for that situation. In another embodiment, the cost to respin the reel may be set to a higher cost than the EV for that situation, which statistically provides a greater value to the casino operator. In another embodiment, the cost to respin the reel may be set to a lower cost than the EV for that situation, which statistically provides a greater value to the player.

Many variations from the respin value determination maybe implemented. For example, instead of evaluating a stack of each symbol type (e.g., populating the reel portion on the visible grid with the same symbol during analysis), each row of the reel may be looped through instead. In such a case, the payouts on paylines that only go through each position (m,n) of one of the populated symbols of type T would be added together.

In another embodiment, accounting for line-initiated bonuses could be accomplished by using the row-based analysis described above for this symbol type, or by the same method as the other line paying symbols using the average value of the bonus per trigger. In one embodiment, the line evaluation method may be implemented where the average bonus value scales with the number of bonus triggers (e.g., [value of 2 triggered bonus]=2*[value of 1 triggered bonus]). Otherwise, the value would be found with the row-based analysis, and stacks of bonus symbols would be analyzed separately.

In another embodiment, instead of looping over all symbol types, the process could also count to determine which symbol types have a potential win. For example, two out of the first three symbols are from a winning symbol combination on reels 1-3, and only loop over those symbol types. In the example of FIGS. 9A and 9B, it could be seen that the symbol types M3 of grid 900C and F9 of grid 900F (FIG. 9A) were absent in the first two reels/columns, and thus it was known they would result in an expected value of zero. Such cases could first be considered to determine whether certain symbol types have a chance to provide a nonzero expected value, and if not, those symbol types could be disregarded to provide further processing efficiencies.

In another embodiment, when the expected value (EV) has been found for a reel that is respun, the EV may be modified in several ways to reach a desired or "tuned" EV. For example, symbol enhancement could be used to enhance symbols to symbols of different potential payout value. In one embodiment, this involves calculating the EV with the nominal game features, then again with the desired enhancement. By weighting the likelihood of both cases, the EV can be tuned to any value between the nominal and enhanced cases. The probability of existing overlay features can also be increased or decreased if a specific reel is to be respun to adjust the total EV.

In another embodiment, if a reel is to be respun, the found value and corresponding cost to respin that reel might not be an integer number. There are ways to alleviate the charging of credit fractions without adjusting the reel EV. For example, a credit bank could be used, similar to the accounting of a progressive increment. Only, this bank could collect the credit fraction on each re-spin bet and/or apply that amount to future re-spins to get integer credit charges. In another embodiment, the credit bank could be combined with a progressive increment system. This would allow a variable increment rate when one reel is respun. If desired, this could allow the player to draw from the increment pool to pay for re-spinning a reel at pre-determined points in the game (reducing the cost of a possible respin).

The features described herein can be used in connection with any game of chance, including slot games, poker games, keno, roulette, bingo, and the like. They may be provided using physical structures, or electronic structures created in computing hardware and displayed as virtual structures of such physical structures. The gaming events described herein may be provided as a base game of chance or an auxiliary gaming event such as a bonus event, free spin event, or other secondary event.

Figure 10A:
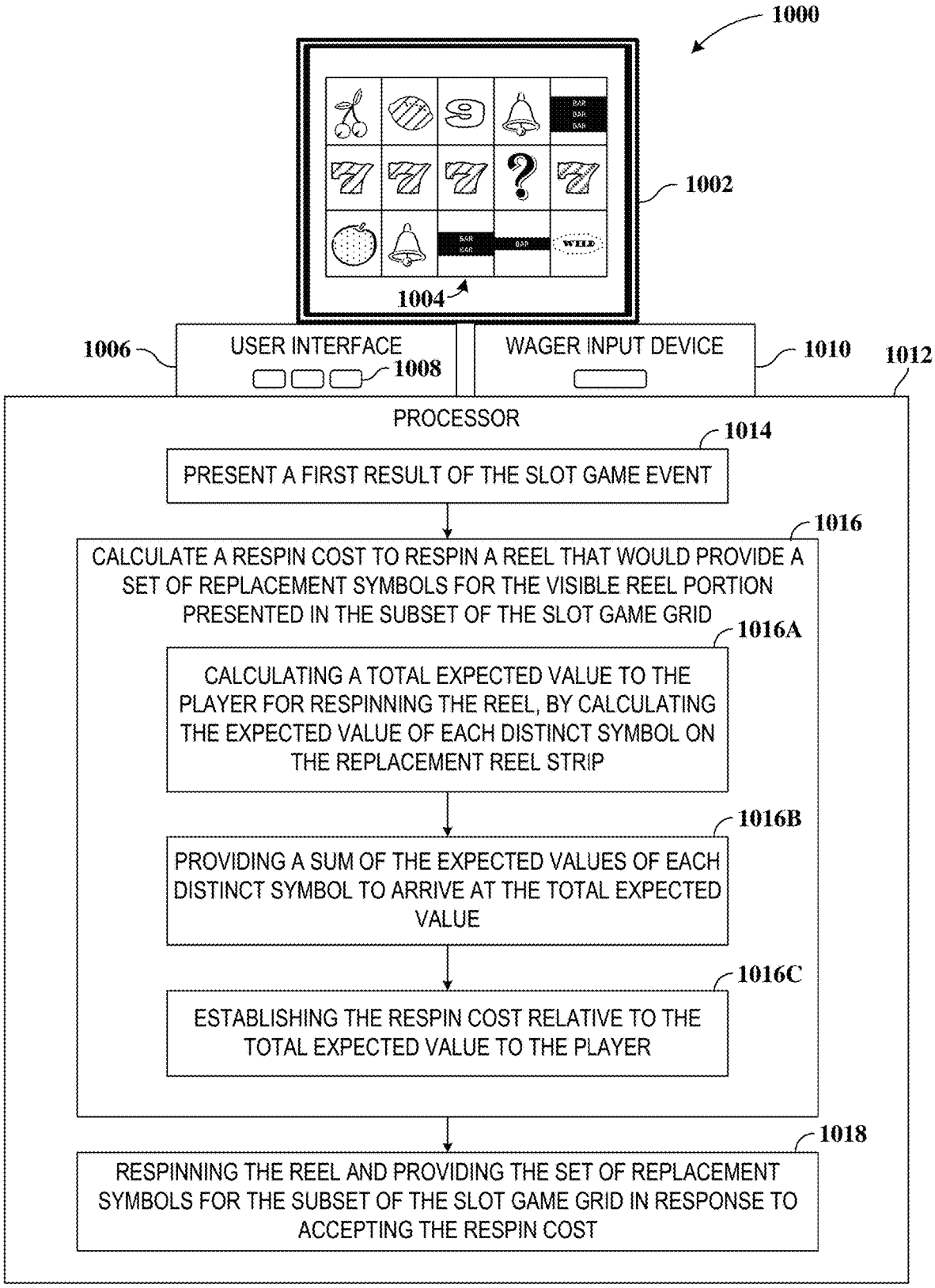
FIGS. 10A and 10B depict block diagrams of representative alternative slot game apparatuses for facilitating the optional replay of portions of gaming grid.

FIG. 10A is a block diagram of a representative slot game apparatus for providing an option to respin at least one reel in a slot game event. In this embodiment, a slot game device 1000 is provided on which players can play slot games. The representative slot game device 1000 includes at least a display 1002 presenting a slot game symbol array or "grid" 1004 of symbol locations, a user interface 1006 including at least one user input 1008 to enable a player to initiate a slot game event presented via the slot game grid 1004, and a wager input device 1010 structured to identify and validate player assets and ultimately permit the player to play the slot game event when the player assets are provided. The slot game device 1000 also includes a processor 1012 configured to present 1014 a first result of the slot game event, and calculate 1016 a respin cost to respin a reel that would provide a set of replacement symbols for the visible reel portion presented in the subset of the slot game grid. In one embodiment, this calculation 1016 includes calculating 1016A a total expected value to the player for respinning the reel, by calculating the expected value of each distinct symbol on the replacement reel strip, providing a sum 1016B of the expected values of each distinct symbol to arrive at the total expected value, and establishing 1016C the respin cost relative to the total expected value to the player. The processor is further configured to respin 1018 the reel and provide the set of replacement symbols for the subset of the slot game grid in response to accepting the respin cost.

The slot game device 1000 configures the processor 1012 (which may include one or more cooperative processing devices) to structurally program functional elements into hardware modules. Processor 1012 circuitry configuration thus changes based on the modules developed by software to carry out the desired methodology. For example, the processor 1012 is programmed by software/code to create a hardware-based module to establish 1014 the monetary threshold, and to create other such software/code modules for each of the operations 1014-1018.

Other structural modules may be created on the slot game device using a properly configured processor 1012. Referring now to the example of FIG. 10B, the processor 1012 may be configured into programmed modules to present 1020 a result of the slot game event including symbols populating a slot game grid comprising (for example) rows and columns, although the principles described herein are applicable to any grid shape or configuration. In this example, the processor is further configured to provide 1022 a respin cost for each of the slot grid columns, and to facilitate 1024 the player's decision whether to respin a reel that populates one of the columns at its respective respin cost. The processor is further configured to determine 1026 whether the player decided to respin a reel, and if so, to facilitate 1030 the player's identification of the reel to respin. The processor is further configured to respin 1032 the elected reel to respin at its respective respin cost, and to present 1034 an updated result of the slot game event. In one embodiment, the steps 1022, 1024, 1026, 1030, 1032 and 1034 are repeated until the player has decided 1026 not to respin any of the reels, in which case the slot game event ends 1028.

Figure 10B:
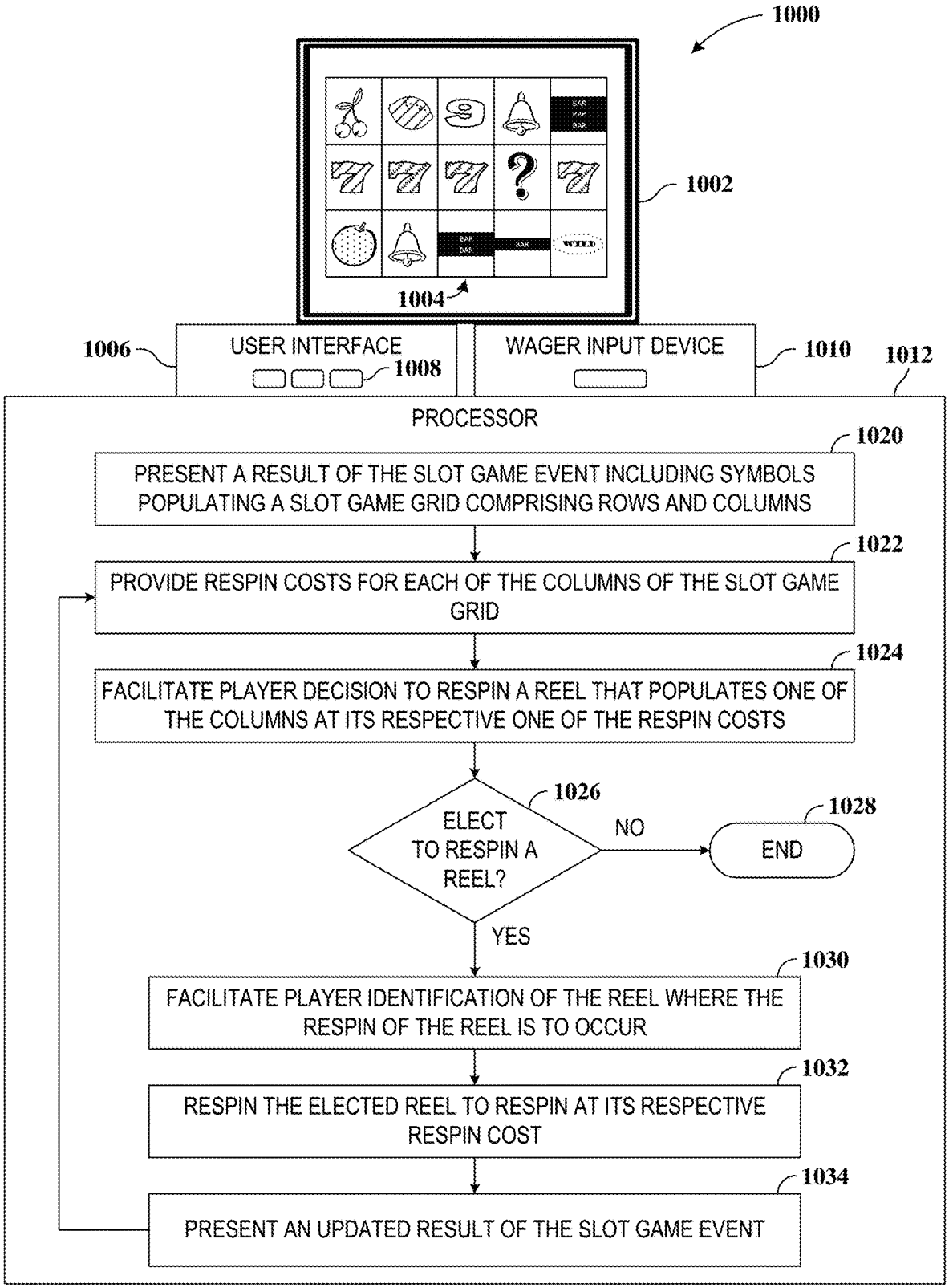

FIGS. 10A and 10B are flow diagrams representing hardware-implemented methods in which a gaming device and/or gaming system can be operated according to embodiments described herein. Although various processes are shown in a particular order in these flow diagrams, the order of these processes can be changed in other embodiments without deviating from the scope or spirit of this concept. Hence, the order of the processes shown is for illustrative purposes only and is not meant to be restrictive. Additional game processes may also be included between various processes even though they are not shown in these flow diagrams for clarity purposes. Further each of the processes may be performed by components in a single game device, such as by a game processor, or may be performed in part or whole by a remote server or processor connected to the gaming device via a network. Each process may be encoded in instructions that are stored in a memory, a computer-readable medium, or another type of storage device. Note that these example methods are just some embodiments of how the steps of a game operation can be implemented. As discussed and shown above, many variations exist which may require additional, fewer, or different processes to complete.

The foregoing description of the representative embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above.

What is claimed is:

1. A slot game device comprising:

a display presenting a plurality of symbol locations forming a symbol array in which symbols are presented;

a user interface including at least one user input to enable a player to initiate slot game events presented via the symbol array;

a wager input device structured to identify and validate player assets, and to permit the player to play the slot game event when the player assets are provided; and a processor configured to:

present a first result of the slot game event;

calculate a respin cost to respin a reel that would provide a set of replacement symbols for a visible reel portion presented in a subset of the symbol array, wherein calculating the respin cost comprises:

calculating a total expected value to the player for respinning the reel, by calculating the expected value of each distinct symbol on the reel to be respun and providing a sum of the expected values of each distinct symbol to arrive at the total expected value, wherein the processor is configured to calculate the expected value of each distinct symbol on the reel to be respun comprises the processor being by;

(a) maintaining the symbols of the first result of the slot game event on the symbol array, except for the symbols in the subset of the symbol array;

(b) populating all symbol locations of the subset of the symbol array with one of the replacement symbols available on the reel to be respun;

(c) calculating the expected value for the replacement symbol;

(d) performing (b) and (c) for each of the distinct symbols on the reel to be respun; and (e) calculating the total expected value to the player for respinning the reel by providing the sum of the expected values of each of the distinct symbols on the reel to be respun;

establishing the respin cost relative to the total expected value to the player; and respinning the reel and providing the set of replacement symbols for the subset of the symbol array in response to accepting the respin cost.

2. The slot game device of claim 1, wherein the processor is further configured to present the established respin cost proximate the reel to create an association of the established respin cost with the reel, and to enable the player to choose whether to respin the reel at the established respin cost.

3. The slot game device of claim 1, wherein the slot game event includes a plurality of reels, and wherein the processor is further configured to calculate a respin cost for each of the plurality of reels used in the slot game event.

4. The slot game device of claim 3, wherein the processor is further configured to present the calculated respin costs for each of the plurality of reels proximate its respective one of the reels to create associations of the respin costs with its respective one of the plurality of reels, and to enable the player to choose which one or more of the plurality of reels to respin at its respective respin cost.

5. The slot game device of claim 1, wherein the processor is configured to establish the respin cost to be equal to the total expected value.

6. The slot game device of claim 1, wherein the processor is configured to establish the respin cost to be higher than the total expected value.

7. The slot game device of claim 6, wherein the processor is configured to set the respin cost above the total expected value to the player by an amount commensurate with a payout percentage of the slot game.

8. The slot game device of claim 1, wherein the processor is configured to establish the respin cost to be lower than the total expected value.

9. The slot game device of claim 1, wherein the calculated total expected value corresponds to a mathematical average expected return for the wager in response to the respin of the reel.

10. The slot game device of claim 1, wherein the reel to be respun is selected from the group comprising a physical reel strip and an electronic reel strip.

11. The slot game device of claim 1, wherein the subset of the symbol array comprises a single one of the plurality of the symbol locations of the symbol array.

12. The slot game device of claim 1, wherein the subset of the symbol array comprises a plurality of the symbol locations arranged in a column of the symbol array.

13. The slot game device of claim 1, wherein the processor is configured to calculate the expected value for the replacement symbol by:

evaluating the symbol grid to identify all winning results and a resulting total payout amount when the symbol locations of the subset of the symbol array have been populated with the one of the replacement symbols currently being considered;

multiply the resulting total payout amount by a quantity of that one of the replacement symbols on the reel to be respun to obtain a product; and divide the product by a total quantity of all of the symbols on the reel to be respun.

14. A slot game device for facilitating optional replay of portions of a slot game, comprising:

a display presenting a plurality of symbol locations forming a symbol array comprising rows and columns, each of the columns of the symbol array representing a portion of a respective reel of symbols;

a user interface including at least one user input to enable a player to initiate slot game events presented via the symbol array;

a wager input device structured to identify and validate player assets, and to permit the player to play the slot game event when the player assets are provided; and a processor configured to:

(a) present a result of the slot game event including the symbols on the reels that are presented in the symbol locations in each of the columns populating the symbol array;

(b) determine a total expected value to the player for respinning each one of the reels by calculating the expected value of each unique one of the symbols on its respective one of the reels and calculating a sum of the expected values of each unique one of the symbols to arrive at the total expected value, and by establishing a respin cost for each respective one of the reels based on the calculated total expected value for the respective one of the reels;

(c) facilitate player decision to respin one of the reels that populates one of the columns of the symbol array at its respective one of the respin costs;

(d) facilitate player identification of the reel where the respin of the reel is to occur;

(e) respin the reel identified by the player at its respective respin cost;

(f) present an updated result of the slot game event; and (g) repeat (b)-(f) until the player has opted not to respin any of the reels.

15. The slot game device of claim 14, wherein the processor is configured to calculate the expected value of each unique one of the symbols on its respective one of the reels identified by the player for the respin by:

(a) maintaining the symbols of the result of the slot game event on the symbol array, except for the symbols at the reel subject to the respin;

(b) populating all symbol locations in the column associated with the reel subject to the respin with one of a plurality of replacement symbols available on the respective reel;

(c) calculating the expected value for the replacement symbol;

(d) performing (b) and (c) for each of the unique ones of the symbols on the reel subject to the respin; and (e) calculating the total expected value to the player for respinning the respective reel by providing the sum of the expected values of each of the unique ones of the symbols on the respective reel.

16. The slot game device of claim 15, wherein the processor is configured to establish the respin cost based on the total expected value to the player by setting the respin cost above the total expected value to the player by an amount commensurate with a payout percentage of the slot game.

* * * * *